US007828235B2

(12) United States Patent
Matlin et al.

(10) Patent No.: US 7,828,235 B2
(45) Date of Patent: Nov. 9, 2010

(54) SHREDDER AUTO FEED SYSTEM

(75) Inventors: Tai Hoon K. Matlin, Round Lake Beach, IL (US); Dipan Pravin Surati, De Plaines, IL (US); Dennis W. Gruber, Arlington Heights, IL (US); Jim Waring, Libertyville, IL (US)

(73) Assignee: Fellowes, Inc., Itasca, IL (US)

( * ) Notice: Subject to any disclaimer, the term of this patent is extended or adjusted under 35 U.S.C. 154(b) by 668 days.

(21) Appl. No.: 11/777,827

(22) Filed: Jul. 13, 2007

(65) Prior Publication Data

US 2009/0014565 A1 Jan. 15, 2009

(51) Int. Cl.

| | |
|---|---|
| ***B02C 4/32*** | (2006.01) |
| ***B02C 7/14*** | (2006.01) |
| ***B02C 9/04*** | (2006.01) |
| ***B02C 11/08*** | (2006.01) |

(52) U.S. Cl. ..... 241/34; 241/100; 241/236

(58) Field of Classification Search ..... 241/34, 241/100, 236

See application file for complete search history.

(56) References Cited

U.S. PATENT DOCUMENTS

| | | | | | |
|---|---|---|---|---|---|
| 4,231,530 | A | * | 11/1980 | Hatanaka | 241/223 |
| 4,232,860 | A | * | 11/1980 | Brown | 271/119 |
| 4,815,669 | A | * | 3/1989 | Fujii | 241/34 |
| 4,815,670 | A | * | 3/1989 | Iwai | 241/34 |
| 4,817,877 | A | * | 4/1989 | Itoh et al. | 241/34 |
| 4,878,626 | A | * | 11/1989 | Leuthold et al. | 241/57 |
| 4,957,243 | A | * | 9/1990 | Kanagaki et al. | 241/34 |
| 5,009,410 | A | * | 4/1991 | Fujii et al. | 271/127 |
| 5,743,473 | A | * | 4/1998 | Gregg | 241/33 |
| 5,772,129 | A | | 6/1998 | Nishio et al. | |
| 5,871,162 | A | * | 2/1999 | Rajewski | 241/100 |
| 5,954,279 | A | * | 9/1999 | Siegfried et al. | 241/166 |
| 7,500,627 | B2 | | 3/2009 | Park et al. | |

(Continued)

FOREIGN PATENT DOCUMENTS

| | | |
|---|---|---|
| DE | 32 15 380 C2 | 10/1983 |

(Continued)

OTHER PUBLICATIONS

Notification of Transmittal of International Search Report, International Search Report and Written Opinion of the International Searching Authority, Oct. 22, 2008, 17 pages.

(Continued)

*Primary Examiner*—Bena Miller

(74) *Attorney, Agent, or Firm*—Pillsbury Winthrop Shaw Pittman LLP

(57) ABSTRACT

The present invention is generally related to an apparatus having cutter elements for destroying articles such as paper sheets and a mechanism for advancing at least a top sheet from a stack of paper in a tray into the cutter elements for shredding. In one embodiment, the apparatus uses a rotatable feed roller to feed paper atop the stack to the cutter elements. The feed roller moves in an alternating manner between a lowered and raised position to engage and disengage the stack when advancing the paper therethrough. Alternatively, a rotatable cam may be used. In an embodiment, the apparatus uses a rotatable drum or rotatable belt with an internal vacuum to lift paper from the stack and feed into the shredder mechanism.

31 Claims, 12 Drawing Sheets

U.S. PATENT DOCUMENTS

| | | | | |
|---|---|---|---|---|
| 2001/0011793 | A1 | 8/2001 | Suzuki | |
| 2002/0190146 | A1* | 12/2002 | Irwin | 241/80 |
| 2005/0023745 | A1 | 2/2005 | Morimoto | |
| 2005/0072870 | A1* | 4/2005 | Dziesinski et al. | 241/236 |
| 2006/0054727 | A1* | 3/2006 | Ko | 241/236 |
| 2007/0235573 | A1* | 10/2007 | Johnson | 241/36 |
| 2008/0179436 | A1 | 7/2008 | Kuraoka | |
| 2008/0197220 | A1 | 8/2008 | Tsai | |
| 2009/0008871 | A1 | 1/2009 | Omi | |

FOREIGN PATENT DOCUMENTS

| | | | |
|---|---|---|---|
| EP | 281 136 | B1 | 7/1991 |
| WO | 2008/095693 | A1 | 8/2008 |
| WO | 2009/035178 | A1 | 3/2009 |

OTHER PUBLICATIONS

Rexel SHRD UK/EU Rexel Auto+ C/C shredder product description and datasheet from Rexel website, obtained from <url: http://www.rexeleurope.com/rexel/en/gb/p/217/2101998/shrd+uk-eu+rexel+auto%2b+c-c.aspx> (2 pages).

* cited by examiner

SHREDDER AUTO FEED SYSTEM

BACKGROUND OF THE INVENTION

1. Field of Invention

The present invention is generally related to an apparatus having cutter elements for destroying documents such as paper sheets. In particular, the apparatus comprises a mechanism for advancing at least a top sheet from a stack of paper in a tray into the cutter elements for shredding.

2. Background

A common type of shredder has a shredder mechanism contained within a housing that is mounted atop a container. The shredder mechanism typically includes a series of cutter elements that shred articles such as paper that are fed therein and discharge the shredded articles downwardly into the container. An example of such a shredder may be found, for example, in U.S. Pat. No. 7,040,559.

Prior art shredders have a predetermined amount of capacity or amount of paper that can be shredded in one pass between the cutter elements. Typically, the sheets of paper are fed into the shredder mechanism manually. Thus, when an operator needs to shred, he or she can only shred a number of sheets of paper by manually inserting one or more sheets one pass at a time. Examples of such shredders are shown in U.S. Pat. Nos. 4,192,467, 4,231,530, 4,232,860, 4,821,967, 4,986,481, 5,009,410, 5,188,301, 5,261,614, 5,362,002, 5,662,280, 5,772,129, 5,884,855, and 6,390,397 B1 and U.S. Patent Application Publications 2005/0274836 A1, 2006/0179987 A1, 2006/0179987 A1, 2006/0249609 A1, and 2006/0249609 A1, which are hereby incorporated by reference in their entirety.

Other shredders are designed for automatic feeding. The shredder will include a bin in which a state of documents can be placed. A feeding mechanism can then feed the documents from the stack into the shredding mechanism. This type of shredder is desirable in an office setting for productivity reasons, as the user can leave the stack in the bin and leave the shredder to do its work. With manual feed shredders, the user would have to spend time feeding smaller portions of the stack manually, thus taking away from productivity time.

SUMMARY OF THE INVENTION

One aspect of the invention provides a shredder comprising a housing and a paper shredder mechanism received in the housing and including an electrically powered motor and cutter elements. The motor rotates the cutter elements in an interleaving relationship for shredding paper sheets fed therein. A tray holds a stack of paper sheets to be fed into the cutter elements. A moveable paper feed mechanism positioned above the tray, and is movable between a lowered position for engaging the stack and a raised position for disengaging from the stack. A feed driver system is constructed to (a) drive the feed mechanism in a feeding direction to feed paper atop the stack to the cutter elements, and (b) move the feed mechanism in an alternating manner between the lowered and raised position such that the feed mechanism alternates between engaging the stack to feed paper and disengaging from the stack to allow the cutter elements to advance the paper therethrough.

The moveable paper feed mechanism may comprise a rotatable feed roller. The shredder may also further comprise an arm connected to the rotatable feed roller for moving the feed roller between the lowered and raised positions. The moveable paper feed mechanism may also comprise a rotatable cam mechanism. The cam mechanism may have an opening that is at least in part air permeable to provide a vacuum to assist in feeding paper sheets. The tray may include a sloped feed bed. The shredder may also include a sensor, timer, or lid.

Another aspect of the invention provides a shredder comprising a housing and a paper shredder mechanism received in the housing that includes a motor and cutter elements. The motor rotates the cutter elements in an interleaving relationship for shredding paper sheets fed therein. A tray holds a stack of paper sheets to be fed into the cutter elements. A moveable paper feed mechanism is positioned above the tray and has an exterior paper engaging surface that is at least in part air permeable. A vacuum generator is provided to apply a vacuum to an interior of the moveable paper feed mechanism to draw air through the exterior paper engaging surface, thereby lifting one or more top sheets from atop the stack. A feed driver system is constructed to drive the feed mechanism to feed paper to the cutter elements.

The shredder may also further comprise a fan mechanism for providing the air to lift at least the edge of at least the top sheet of the stack. The fan mechanism may be the vacuum generator. The moveable paper feed mechanism may be a rotatable drum or a belt. The tray may include a sloped feed bed. The shredder may also include a sensor, timer, or lid.

In another aspect of the invention, a method is provided for advancing paper sheets into cutter elements for shredding. The method comprises: providing a tray for holding a stack of paper sheets; providing a moveable paper feed mechanism to advance paper sheets into the cutter elements; rotating cutter elements in an interleaving relationship for shredding paper sheets fed therein; driving the feed mechanism in a feeding direction to feed paper to the cutter elements from atop the stack of paper sheets in the tray, and moving the feed mechanism in an alternating manner between a lowered and raised position such that the feed roller alternates between engaging the stack to feed paper and disengaging from the stack to allow the cutter elements to advance and shred the paper therethrough.

Another aspect of the invention provides a method for advancing paper sheets into cutter elements for shredding. The method comprises: providing a tray for holding a stack of paper sheets; providing a moveable paper feed mechanism positioned above the tray, the moveable paper feed mechanism having an exterior paper engaging surface that is at least in part air permeable; applying a vacuum to an interior of the moveable paper feed mechanism to draw air through the exterior paper engaging surface, thereby lifting one or more sheets from atop the stack to the exterior paper engaging surface of the drum; rotating cutter elements in an interleaving relationship for shredding paper sheets fed therein; and driving the feed mechanism to feed the one or more lifted sheets to the cutter elements.

Other objects, features, and advantages of the present invention will become apparent from the following detailed description, the accompanying drawings, and the appended claims.

DETAILED DESCRIPTION OF THE PREFERRED EMBODIMENT(S) OF THE INVENTION

Figure 1:
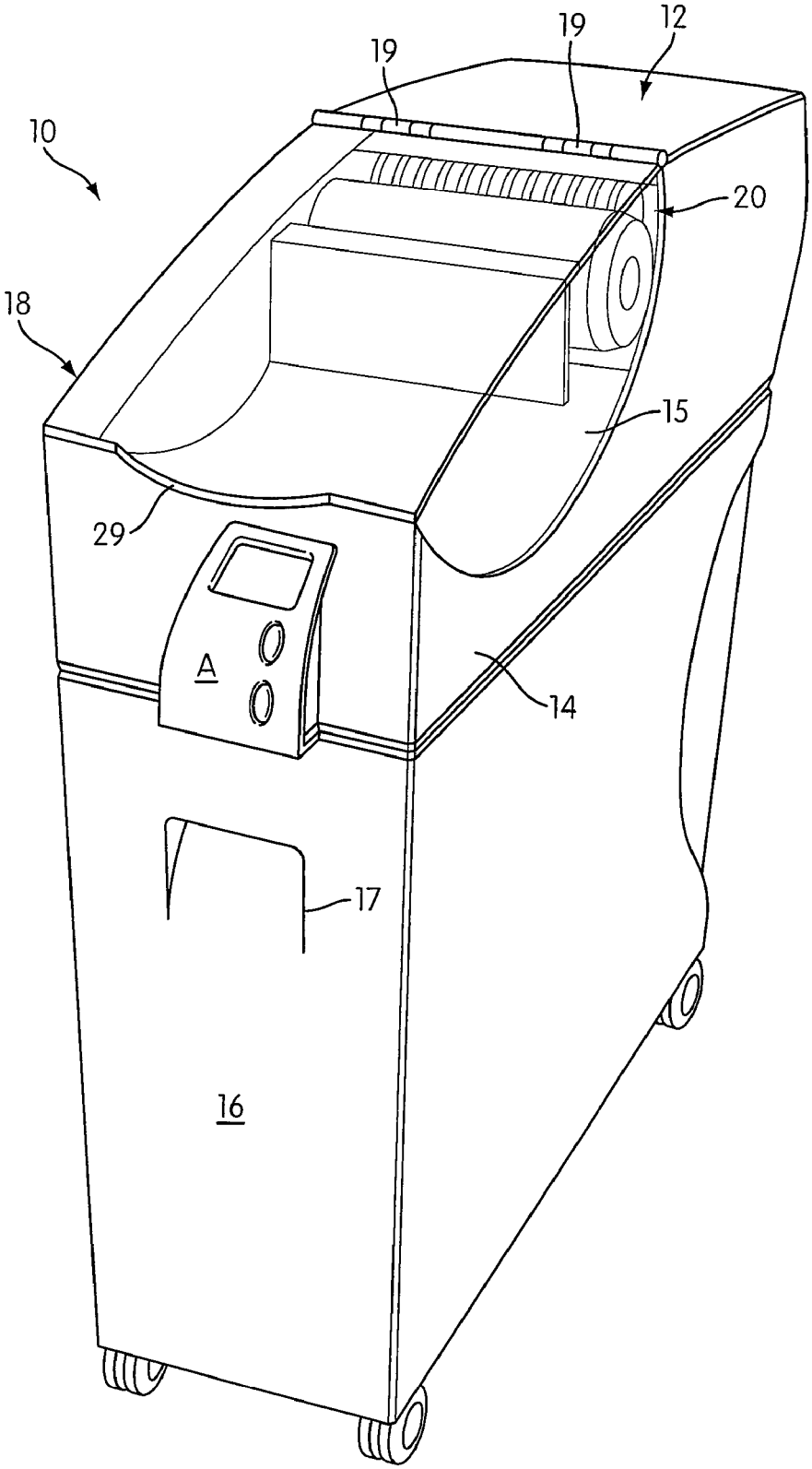
FIG. 1 is a perspective view of a shredder in accordance with an embodiment of the present invention.

FIG. 1 is a perspective view of a shredder in accordance with an embodiment of the present invention. The shredder 10 is designed to destroy or shred articles such as paper. The shredder 10 comprises a housing 12 that sits on top of a container 16, for example. The container 16 receives paper that is shredded by the shredder 10. The container 16 may comprise a hole or opening 17 for a user to grasp. For example, the user may grab opening 17 to open or access the inside of the container 16, as described below with reference to FIGS. 7*a*-7*c*. The container 16 may be a waste bin, or may also be used to house a separate and removable waste bin, for example.

Generally speaking, the shredder 10 may have any suitable construction or configuration and the illustrated embodiment is not intended to be limiting in any way.

The shredder 10 comprises a paper shredder mechanism 20 in the housing 12, and includes a drive system with at least one motor, such as an electrically powered motor, and a plurality of cutter elements 21. The cutter elements are mounted on a pair of parallel mounting shafts (not shown). The motor operates using electrical power to rotatably drive first and second rotatable shafts of the shredder mechanism 20 and their corresponding cutter elements 21 through a conventional transmission so that the cutter elements 21 shred or destroy articles fed therein. The shredder mechanism may also include a sub-frame for mounting the shafts, motor, and transmission. The drive system may have any number of motors and may include one or more transmissions. Also, the plurality of cutter elements 21 are mounted on the first and second rotatable shafts in any suitable manner and are rotated in an interleaving relationship for shredding paper sheets fed therein. The operation and construction of such a shredder mechanism 20 is well known and need not be discussed herein in detail.

The housing 12 of shredder 10 is designed to sit atop a container 16, as noted above. The housing 12 works in cooperation with a cartridge or tray 14, shown in detail in FIG. 2. Tray 14 comprises a feed bed 15 and is designed to hold a plurality or stack of paper sheets 22 that are to be shredded. The tray 14 is mounted such that the paper may be fed from bed 15 of the tray 14 and into the cutter elements 21 of the shredder mechanism 20. For example, the tray 14 and shredder mechanism 20 may be mounted horizontally such that the paper is fed into the shredder mechanism 20 and destroyed. In an embodiment, the tray 14 comprises a sloped feed bed 15 (see, e.g., FIGS. 3*a*-3*e*). The sloped feed bed 15 assists in feeding sheet(s) atop a stack 22 in a forward and upward direction into the shredder mechanism 20, for example. A sloped feed bed 15 also assists in preventing jamming of the paper in the shredder mechanism 20.

In another embodiment, the tray 14 may comprise a sectioned or partitioned bin, providing limited access to an upper bin, for example, while documents in lower bin are fed to the shredder mechanism 20.

Figure 2:
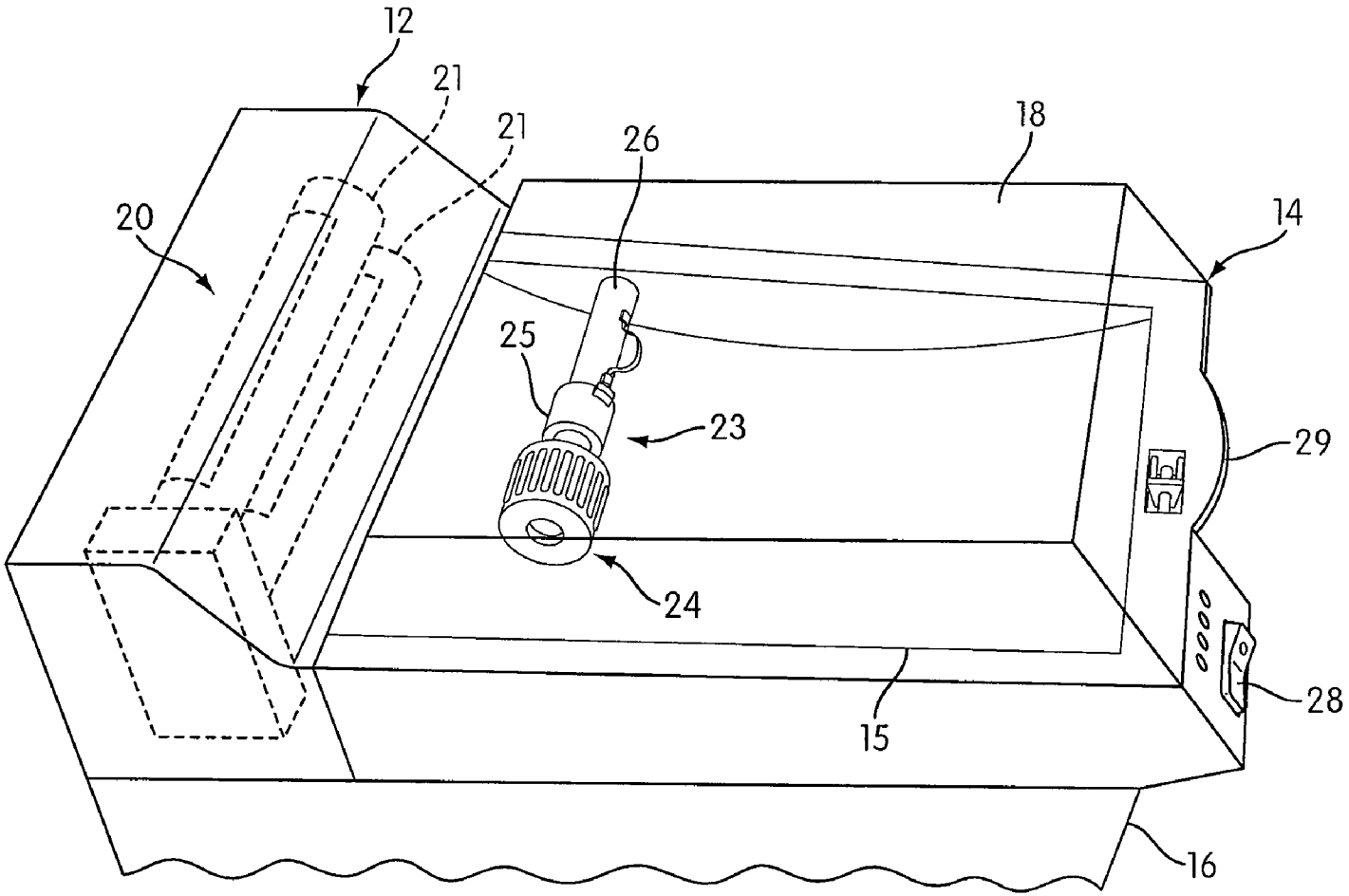
FIG. 2 is an overhead view of a rotatable feed roller mechanism in accordance with an embodiment of the present invention.

In an embodiment, the tray 14 is provided with a lid 18. The lid 18 is provided with hinges 19 such that the lid 18 may be pivoted between an open and closed position. Pivoting the lid 18 allows a user access to the inside of tray 14, such as for filling the tray 14 with paper to be shredded. In an embodiment, the tray 14 comprises a handle 29 to assist in lifting the lid 18. For example, FIGS. 1 and 2 illustrate embodiments of the handle 29. FIGS. 1 and 2 illustrate a handle 29 in the form of a lip provided near or on an edge of the lid 18. In an embodiment, the handle may extend from the side of the lid 18 on top of tray 14. However, any type or form of handle 29 for assisting in lifting the lid 18 may be used and should not be limiting.

In an embodiment, the lid 18 may comprise a safety switch. The safety switch may be used to detect if the lid is pivoted to an open position. The safety switch may be coupled to the shredder mechanism 20 to prevent operation of the cutter elements 21 when the lid 18 is in the open position. Similarly, when the lid 18 is in a closed position, the shredder mechanism 20 may be activated to begin operation of the cutter elements 21 and an advancement (or feed) mechanism, as will be described.

The tray 14 or lid 18 may also comprise a locking mechanism that prevents a user from opening the lid or accessing the tray, which may not be desirable while the shredder is in use. For example, the lid 18 may include a magnetic latch. Alternatively, the tray or lid may include a code lock that prevents a user from opening the lid or having access to the tray. For example, a user may need to input a code into a control panel, such as a control panel A as shown in FIG. 1, for access to the documents to be shredded in the tray 14. Further description for the control panel A is provided with respect to FIG. 12 below.

In an embodiment, lid 18 may comprise an opening (not shown) for allowing insertion of paper sheets into the tray 14. In another embodiment, an opening may be provided below the lid 18. That is, as shown in FIG. 3*e*, for example, when the lid 18 is in the closed position, an opening or gap 32 may be formed between the lid and bottom of the tray 14 or feed bed. Thus, the tray 14 may also be filled by inserting paper sheets (e.g., a single sheet or a small stack) through the gap 32 and into the feed bed without having to lift the lid 18. This feature may be advantageous, for example, where the shredder is running and feeding from a large stack and the user simply wants to add a small number of documents to the tray 14 or bed 15. Rather than opening the lid 18 and stopping the shredding process with the safety switch, the user can just slip the small number of documents into the stack 22 via the gap 32. However, the use of a lid in general is optional and may be omitted entirely. A user may add paper to the tray 14 through an open top, for example.

The tray 14 is designed to hold a stack 22 of paper sheets therein that are to be shredded. The paper sheets may be of any type, size, or construction (e.g., white paper, letter size, legal size, A4, envelopes, etc.).

Figure 12:
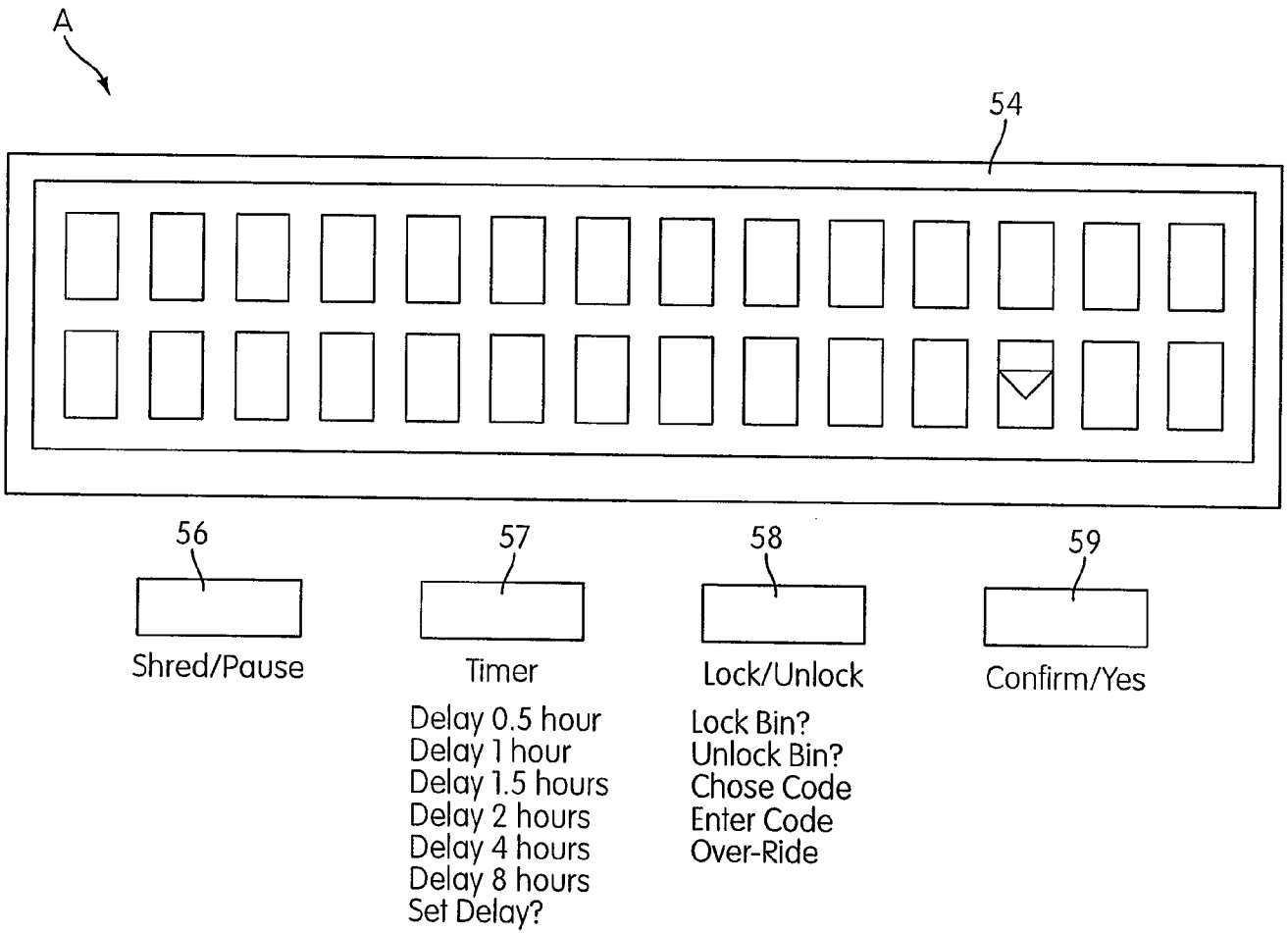
FIG. 12 is a detailed view of a control panel for use with the shredder of FIG. 1 in accordance with an embodiment of the present invention.

As previously noted, a control panel A may be provided for use with the shredder 10. FIG. 12 illustrates a detailed view of a control panel A in accordance with an embodiment of the present invention. As shown, the control panel A comprises at least a screen 54 and a plurality of buttons 56, 57, 58, and 59. Any number of buttons, however, may be provided. The screen 54 may be an LCD screen, for example, to show available menus or options to a user. Lights, LEDs, or other known devices (not shown) may also be provided on control panel A. Generally, the use of a control panel is known in the art.

The buttons 56-59 on control panel A are provided to assist the user with the shredder 10 and communicate actions to the controller, e.g., to turn on the shredder mechanism, start the timing mechanism, etc. For example, button 56 may be used to communicate the state of the shredder's particular condition (e.g., ON, OFF). Button 56 may be used to activate or pause the shredder mechanism 20 in the shredder 10. The status of the shredder, e.g., "Shredding" or "Pause" may also appear on the screen 54, for example.

Button 57 may be a timer button, for example. In an embodiment, the timer button 57 is used to set a time delay. The button 57 may be pressed by a user to display or scroll through available delay times for setting the shredder mechanism 20 on a delayed start, for example, such as 30 minutes or 1 hour. Once a user chooses a time delay, the user then confirms the selection by pressing the confirmation button 59, for example. Thus, the timer button 57 used to set a timer (not shown) for controlling at least a time to start movement of an advancement or feed mechanism to advance paper sheets into the shredder mechanism 20, as will be described in the embodiments below.

Button 58 may be a lock/unlock button, for example, that allows a user to lock access to the bin. For example, as noted above, lid 18 may include a magnetic latch for prohibiting access to the tray 14. Thus, lock button 58 may be used to lock the magnetic latch and therefore prevent a user from opening the lid or having access to the tray. To unlock the lid 18 and provide the user access to the tray 14, a user presses lock button 58 and inputs a code into the control panel A (e.g., the screen may prompt a user for an unlock code). Similarly, the lock button 58 may be used to lock the lid 18 with respect to the tray 14, such that when the lid 18 is closed, the user presses button 58 and is prompted to enter a code for activating the lock mechanism (e.g., magnetic latch).

As previously noted, button 59 is provided as a confirmation button, allowing a user to confirm a selection or entry when completed or when prompted. Thus, when a user wants to complete entry of a code, either for unlocking or locking, the confirmation button 59 may be pressed.

The shredder 10 also comprises a mechanism opposed to or adjacent the tray surface for advancing at least a top sheet from a stack of paper in a tray into the cutter elements for shredding. That is, shredder 10 is designed with an advancement mechanism for automatically feeding one or more sheets to a shredder mechanism 20 without requiring a user to manually feed individual or a preset quantity of sheets into the cutting elements 21.

FIG. 2 shows in detail an embodiment of an advancement mechanism in accordance with the present invention comprising a feed mechanism 23. The feed mechanism 23 comprises a rotatable feed roller 24, arm 26, and a feed driver system 25 designed to work in cooperation with the stack 22 in the tray 14. As shown, the rotatable feed roller 24 of the feed mechanism is positioned above or adjacent the bed 15 of the tray 14.

In an embodiment, the rotatable feed roller 24 is mounted on the arm 26. The arm 26 is used to move the rotatable feed roller 24 between a lowered position for engaging the stack 22 and a raised position for disengaging from the stack. In an embodiment, the arm may be an articulating or pivoting arm. In another embodiment, the rotatable feed roller 24 is eccentrically mounted to an axle so that in a relative sense it cycles between the raised and lowered positions as it rotates.

The arm 26 may be moved, for example, via a motor and a gear or wheel mechanism(s). Generally, known links, gears, drive axles, and other devices may be used to connect the arm to the motor. The motor used to move or activate the arm 26 may be shared (e.g., with the shredder mechanism 20), or a separate motor may be provided specifically for activating the arm 26.

In one embodiment, the feed driver system 25 comprises a driver for moving the arm between the lowered and raised positions. In an embodiment, as shown in FIG. 2, a rotary driver is mounted to the arm 26 for rotating the rotatable feed roller 24.

In another embodiment, the rotatable feed roller 24 is eccentrically mounted to an axle, and the feed driver comprises a rotary driver for rotating the axle so that the rotation of the feed roller feeds the paper atop the stack. The rotary driver is also used to move the feed roller in an alternating manner between the lowered and raised positions by the eccentric mounting.

In an embodiment, the feed roller 24 of the arm 26 is activated and rotated when the lid 18 of tray 14 is closed. The arm 26 may be activated and articulated (e.g., up and down or pivotally) when the lid 18 of the tray 14 is closed. The arm 26 may move cyclically with respect to the shredder mechanism 20 when the shredder mechanism 20 is activated. For example, the arm 26 may be connected via a gear(s) such that when the motor for the shredder mechanism 20 is activated (i.e., cutter elements 21 are activated), the rotation and cyclic movement (i.e., up and down or pivoting) motion of the arm 26 is activated. When the lid 18 is lifted to access the tray 14 the motor may be deactivated, thus the arm 26 is prevented from movement (e.g., either pivotally or up and down, or the rotation of the feed roller 24, or both). In an embodiment, a separate motor may be provided for the rotation of the feed roller 24 on arm 26.

In an embodiment, the feed roller 24 and/or arm 26 is removable or replaceable, for example, if damaged.

In an embodiment, the feed driver system is constructed to rotate and move the feed roller 24, as will be described below.

In an embodiment, the rotatable feed roller 24 is a plurality or array of drive wheels or rollers 24. For example, two or more rollers may be provided on the end of arm 26. A plurality of rollers aids in covering a greater length or width of the tray 14 and thus aids in feeding at least the top sheet(s) of paper from the stack 22.

In an embodiment, the rotatable feed roller 24 is mounted directly to a rotating axle (i.e., not on the arm 26).

A power switch 28 may also be provided on the shredder 10. The power switch 28 may be provided on tray 14, for example, or anywhere else on the shredder 10. The power switch 28 includes a manually engageable portion connected to a switch module (not shown). Movement of the manually engageable portion of switch 28 moves the switch module between states. The switch module is communicated to a controller (not shown) which may include a circuit board. Typically, a power supply (not shown) is connected to the controller by a standard power cord with a plug on its end that plugs into a standard AC outlet. The controller is likewise communicated to the motor of the shredder mechanism 20. When the switch 28 is moved to an on position, the controller can send an electrical signal to the drive of the motor so that it rotates the cutting elements 21 of the shredder mechanism 20 in a shredding direction, thus enabling paper sheets to be fed therein. The switch 28 may also be moved to an off position, which causes the controller to stop operation of the motor. Further, the switch 28 may also have an idle or ready position, which communicates with the control panel A. The switch module contains appropriate contacts for signaling the position of the switch's manually engageable portion. Generally, the construction and operation of the switch 28 and controller for controlling the motor are well known and any construction for these may be used. Also, the switch need not have distinct positions corresponding to on/off/idle, and these conditions may be states selected in the controller by the operation of the switch.

In an embodiment, a sensor is provided in tray 14 for sensing the presence of paper sheets or a stack 22. The sensor may be used to communicate with the controller that sheets are ready to be shredded or destroyed, or to communicate with the feed driver system. The presence of sheets may also start a timer. For example, a time delay may be activated such that a feed mechanism 23 begins to move or rotate after a set period of time (e.g., 30 minutes, 1 hour). The sensor may be of any type, e.g., optical, electrical, mechanical, etc. and should not be limiting. Additionally, audio sensors may be used with tray 14. For example, a sensor may be able to pick-up audio signals or sounds when paper is shredding or as paper is lifted.

FIGS. 3*a*-3*e* show side views of the rotatable feed roller mechanism 23 of FIG. 2 for advancing paper in accordance with an embodiment of the present invention. As previously noted, the feed driver system (not shown) of shredder 10 is constructed to rotate and move the rotatable feed roller 24. The feed driver system (not shown) is constructed and arranged to rotate the feed roller 24 to engage and feed paper atop the stack 22 in the bed 15 of the tray 14 to the cutter elements 21 of the shredder mechanism 20, and move the feed roller in an alternating manner between a lowered and raised position such that the feed roller 24 alternates between engaging the stack 22 to feed paper and disengaging from the stack 22 to allow the cutter elements to advance the paper therethrough.

Figure 3A:
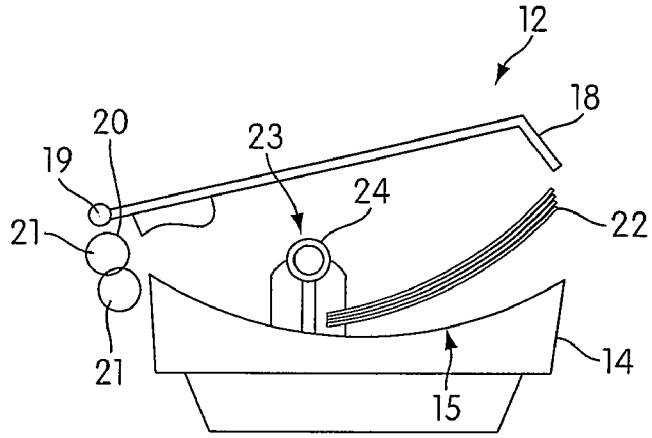
FIGS. 3*a*-3*e* show side views of the rotatable feed roller mechanism of FIG. 2 for advancing paper in accordance with an embodiment of the present invention.
Figure 3B:
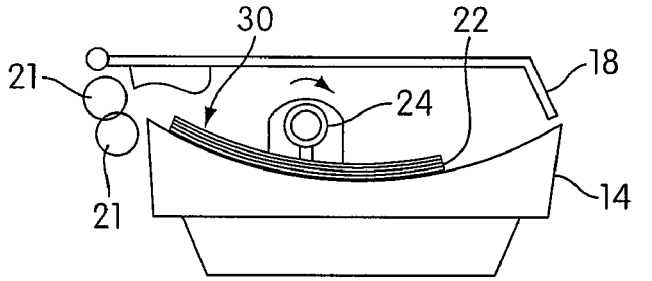

As shown in FIG. 3*a*, the lid 18 may be pivoted upon hinges 19 to allow access to the inside of the tray 14 or feed bed 15. In an embodiment, when the lid 18 is lifted, the rotatable feed roller 24 is actuated such that it moves up to a raised position such that paper may be inserted into the feed bed 15 of the tray 14. After insertion of the paper sheets or stack 22, the lid 18 is pivoted closed as seen in FIG. 3*b*, and the shredder mechanism 20, feed drive mechanism 23, and feed driver system 25 of the shredder 10 are activated (e.g., upon closure of the lid, via sensor, or manually). As noted above, a sensor detecting the presence of paper on the feed bed 15 may be used to communicate and activate the feed driver system, i.e., the rotatable feed roller 24, using an optical sensor, electromechanical sensor, or switch. In an embodiment, the driver system comprises a timer for controlling at least the start time for movement of the rotatable feed roller 24 and/or the arm 26 in an alternating manner between the lowered and raised positions.

Figure 3C:
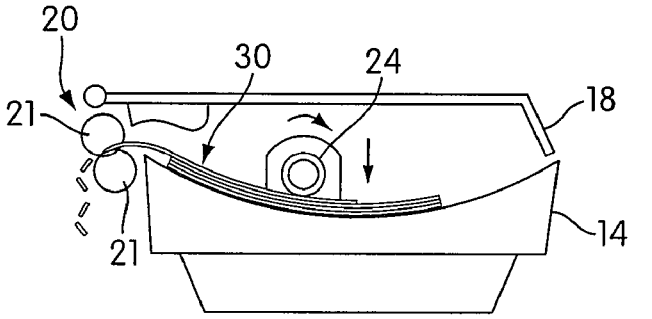
Figure 3D:
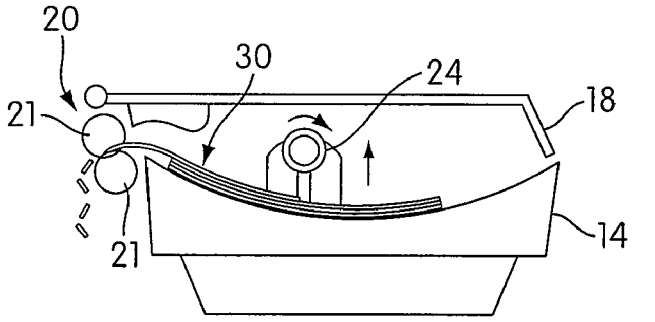
Figure 3E:
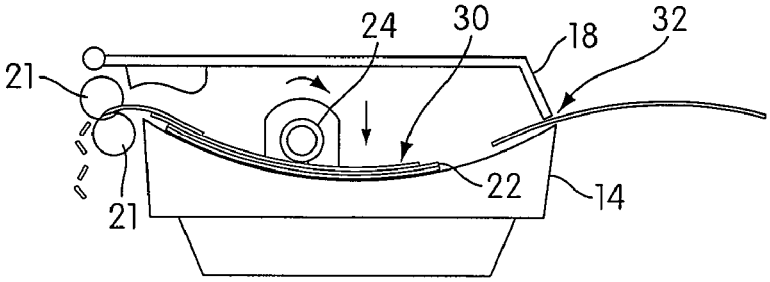

When the shredder 10 is activated, the rotatable feed roller 24 is lowered such that it engages the top of the stack 22, as shown in FIG. 3*c*. The feed drive system activates the roller 24 such that at least a top sheet 30 of the stack 22 is fed into the shredder mechanism 20. Specifically, the roller 24 is rotated and the sheet(s) 30 is advanced and fed forward and into the cutting elements 21 of the shredder mechanism 20. As the sheet(s) 30 is (are) fed forward, the rotatable feed roller 24 moves to a raised position, as shown in FIG. 3*d*, such that the roller 24 disengages from the stack 22. The sheet(s) 30 are then grasped and pulled into the shredder mechanism 20 by the cutter elements 21. The feed roller 24 then moves back to the lowered position, as seen in FIG. 3*e*, to thus re-engage the stack 22 and advance the next or top sheet(s) into the shredder mechanism 20.

The advantage of raising and lowering the rotatable feed roller 24 in an upward and downward movement is that it reduces jamming from occurring. Additionally, a sloped feed bed also aids to prevent jamming.

In an embodiment, the movement of the feed roller 24 need only be used to advance sheet(s) partially, such that the cutter elements 21 themselves grasp and pull the rest of the sheet(s) therebetween. Thus, sheets or paper which is torn, folded, of different size (e.g., letter size, legal size, etc.), type (e.g., white paper, envelopes, etc.), or construction are advanced into the shredder mechanism 20 with only limited rotation of the feed roller 24 (i.e., instead of continuous rotation).

Figure 4:
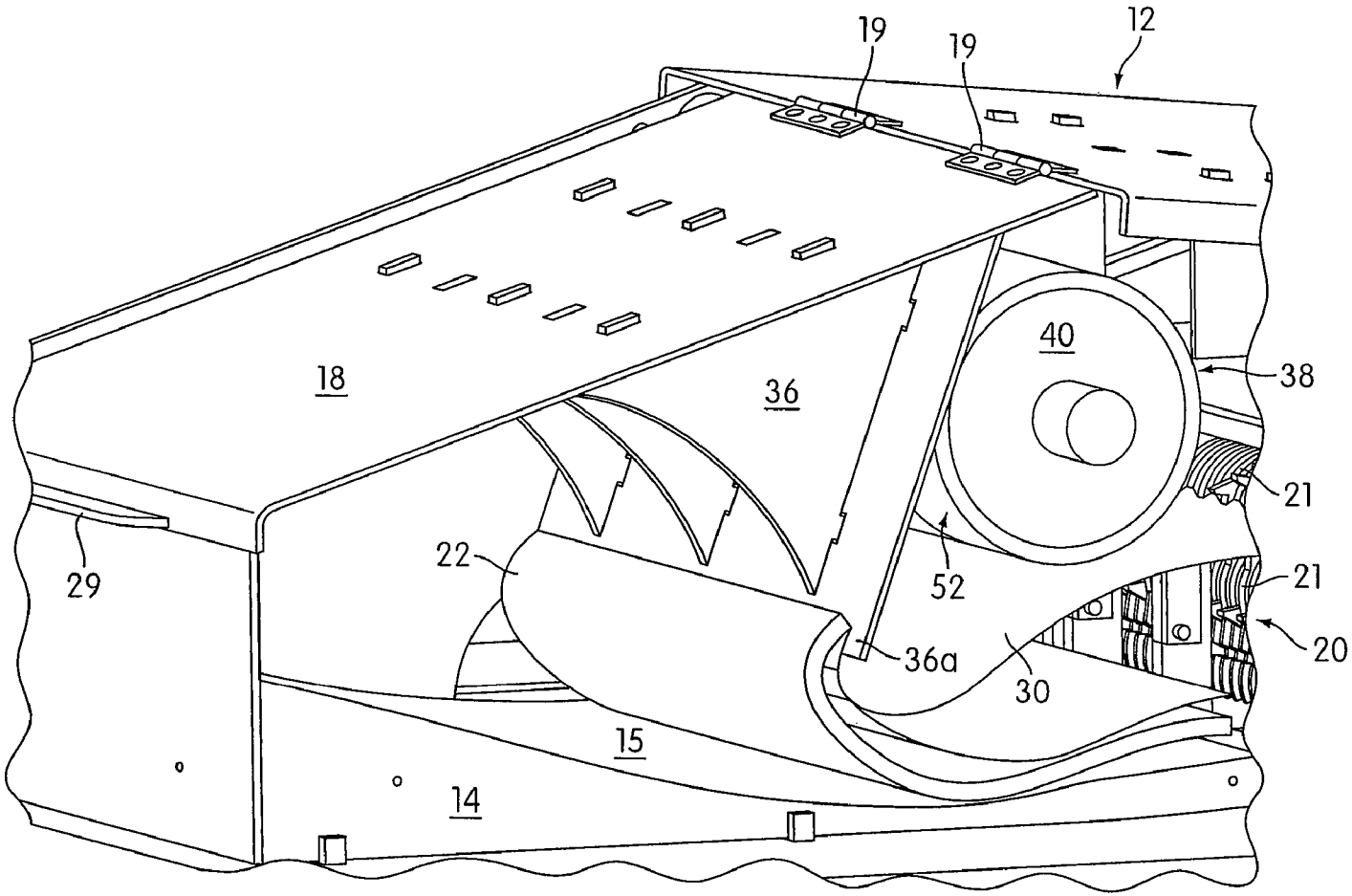
FIG. 4 is a detailed side view of a rotatable drum in accordance with an embodiment of the present invention.
Figure 10:
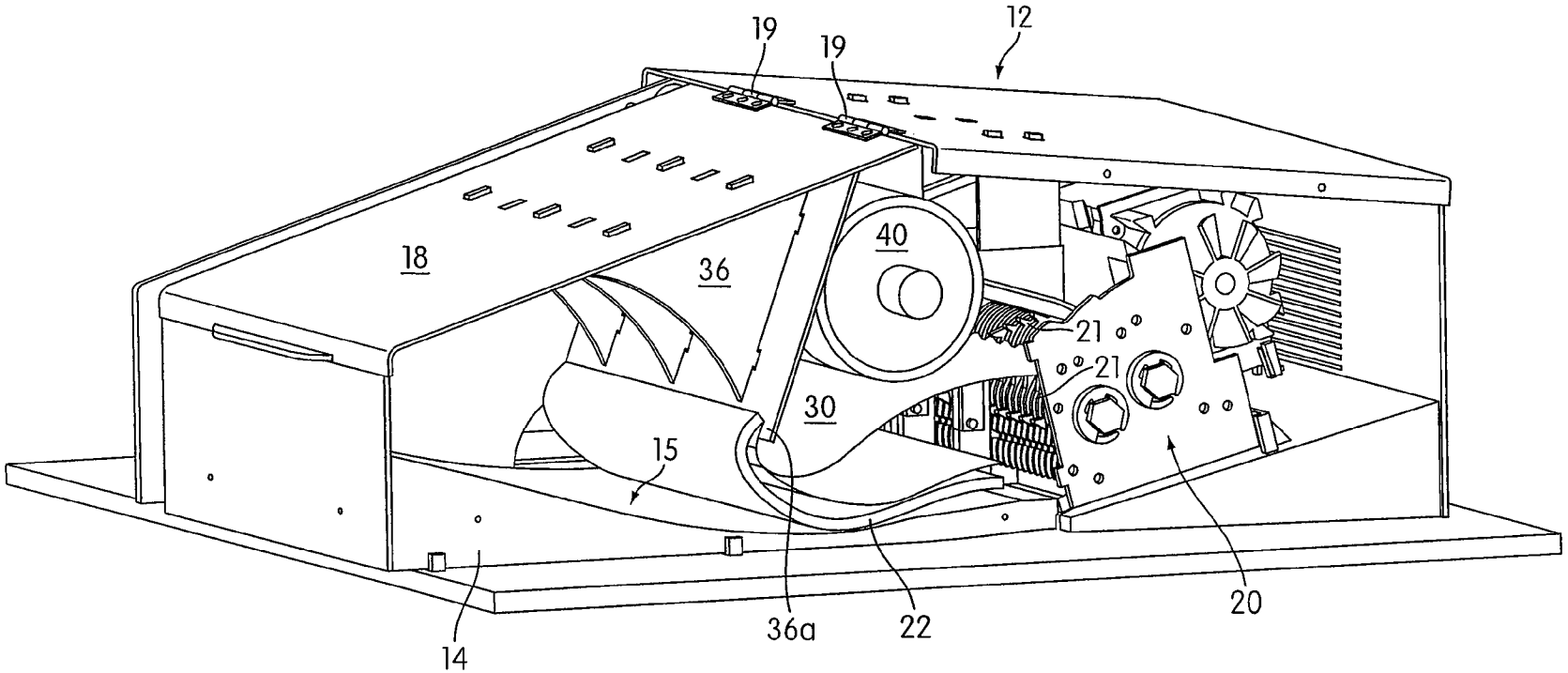
FIG. 10 shows a perspective side view of a stripping device that may be used with the paper shredding mechanism of a shredder in accordance with an embodiment of the present invention.

The shredder 10 may also comprise a stripper device 36 for stripping paper sheets from staples, shown in FIGS. 4, 10, and 11. Although FIG. 4 describes an additional embodiment, the device 36 of FIGS. 4, 10, and 11 may also be provided in the embodiments described in FIGS. 2-8*f*. The stripper device 36 may be provided in the tray 14, for example. In one embodiment, as shown in FIGS. 4 and 10, the stripper device 36 is attached to the lid 18. The stripper device 36 may be designed such that it is adjacent to the stack 22 and in front of the feed mechanism 23 or rotatable feed roller 24 (or any other advancement mechanism as disclosed in FIGS. 2-8*f*). In an embodiment, the stripper devices 36 is provided in front of a rotating shredder auto-feed mechanism. In an embodiment, the stripper device 36 is provided behind the rotating shredder auto-feed mechanisms (e.g., rotatable feed roller 24 or rotatable drum 40).

Figure 11A:
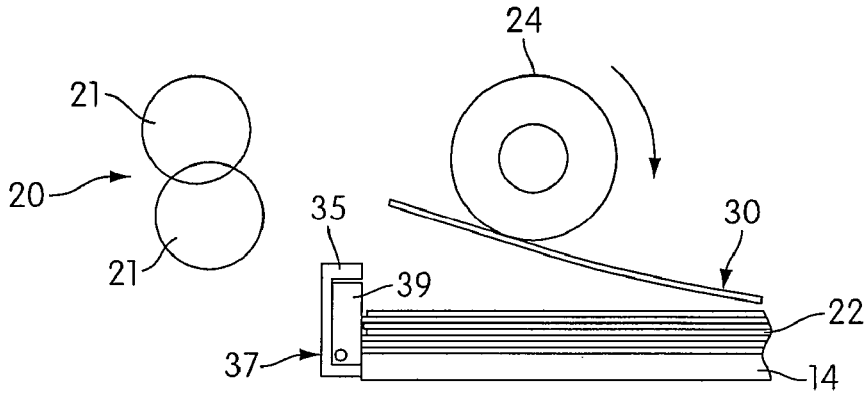
FIGS. 11*a*-11*c* show a side view of a stripping device of alternative configuration that may be used with the paper shredding mechanism of a shredder in accordance with an embodiment of the present invention.
Figure 11B:
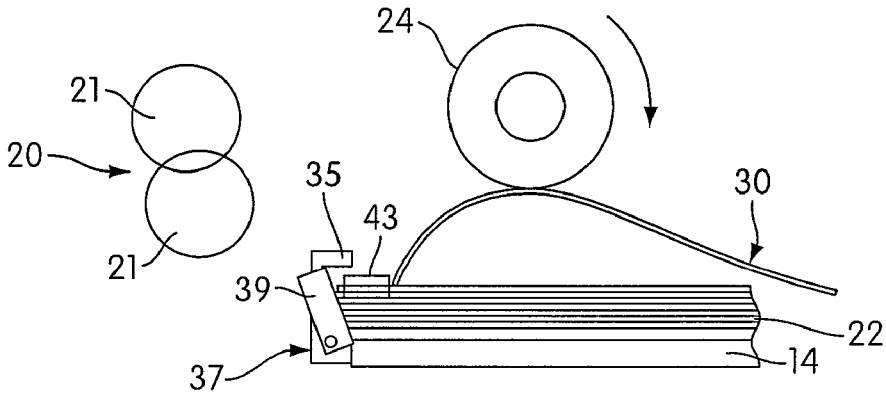
Figure 11C:
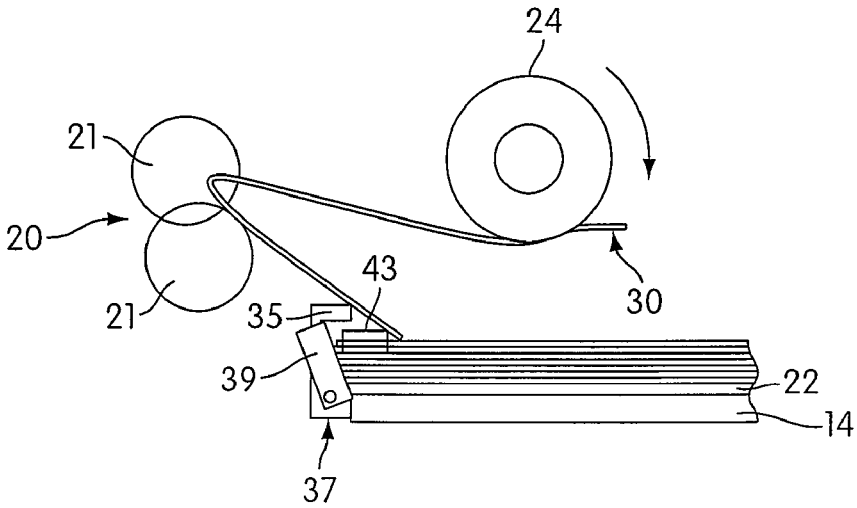

FIGS. 11*a*-11*c* show a side view of a stripper device 37 of alternative configuration. The stripper device 37 comprises a holding portion 35 and a pivoting portion 39. The pivoting portion 39 pivots relative to the holding portion, as described below. The stripper device 37 is provided near the end of the stack 22 in the tray 14. The stripper device 37 may designed to be adjacent the edges of paper sheets. The stripper device 37 may be provided in front of the shredder mechanism 20 and cutting elements 21 and behind or in back of the feed mechanism 23 or rotatable feed roller 24. In an embodiment, the stripper device 37 is provide adjacent the edges(s) of stack 22 in the tray and behind a shredder auto-feed mechanism.

The device 36 is used to strip paper sheets that are stapled together in the stack 22 from a staple as the paper sheets are fed to the cutter elements of the shredder mechanism 20. In an embodiment, the device 36 has an extended surface or lip 36*a* that extends into the path of which stapled sheets or documents are drawn. Thus, as a sheet(s) of a stapled document is grasped by the rotatable feed roller 24, the extended surface 36*a* intercedes by holding or providing resistance to at least the top edge (e.g., near the staple) of the stapled documents. Thus, as the rotatable feed roller 24 feeds the sheet into the shredder mechanism 20, and the cutter elements 21 advance the sheets therethrough, the device 36, 36*a* cooperatively provides resistance to at least the top edge of the document allowing for the paper sheet(s) to be stripped from the stapled edge. Optionally, the extended surface or lip 36*a* of device 36 during operation of the roller 24 and shredder mechanism 20 provides enough resistance to tear a sheet from the stapled documents, such that as each sheet is grasped and fed toward the shredder mechanism 20 by the rotatable feed roller 24, the sheet is removed from the stapled document.

Similarly, the device 37 of FIGS. 11*a*-11*c* may also be used to strip paper sheets that are stapled together in the stack 22. FIG. 11*a* illustrates a stack 22 in the tray 14 without staples, with stripper device 37 near edges of the sheets in the stack 22. FIGS. 11*b*-11*c* illustrate how at least a top sheet 30 being fed by the roller 24 is stripped from a staple 43 holding a stack of sheets together. Specifically, at least one top sheet 30 is grabbed by the advancement mechanism (e.g., roller 24). As sheet 30 is rotated by roller 24 toward the cutting elements 21 of shredder mechanism, the sheet 30 is forced to bend. The movement of the sheet 30 forces the rest of the stack of stapled sheets to press against the pivoting portion 39 of the stripping device 37. Thus, the stack pivots the pivoting portion 39 relative to the holding portion 35. As shown in FIG. 11*b*, the stapled stack is pushed forward into the device 37 and is held by holding portion 35. When the sheet 30 bends and is fed forward toward the shredder mechanism 20, the staple 43 (i.e., sheets) is held in place by holding portion 35 as the sheet 30 is grasped by the cutting elements 21. The cutting elements 21 then pull the sheet 30 into the shredder mechanism 20 (to be shredded), as shown in FIG. 11*c*. The cutting elements 21 provide resistance with respect to the stack and strip or tear the sheet 30 from the staple 43 of the document.

In an embodiment, both stripper devices 36 and 37 may be used in shredder 10. The shredder devices 36 and 37 work in cooperation with the auto feed mechanism or advancement mechanism to feed stapled documents or sheets from the tray. The use of both stripper devices 36 and 37 provide an advantage to the user in that the user does not need to place or orient the documents/sheets in the tray 14 in a specific matter. Specifically, the orientation of the sheets may be such that stapled documents/sheets are placed in the tray 14 with the direction of the staples being adjacent the shredder mechanism 20 and/or behind the feed mechanism (e.g., toward the opening of the tray 14). Despite the orientation of the staples, the devices 36 and 37 will provide resistance to at least the top sheet(s) 30 being fed into the cutter elements 21 and pull or strip the sheet(s) 30 from the staple 43.

FIG. 4 also illustrates a side view of another embodiment of an advancement mechanism for shredder 10 in accordance with the present invention comprising a rotating drum mechanism 38. The rotating drum mechanism 38 may be used as an advancement mechanism in a similar manner as previously described with reference to the shredder 10 of FIG. 1. The shredder 10 of FIGS. 4-6*e* comprises a housing 12, tray 14, container 16, and paper shredder mechanism 20 as previously noted. The shredder mechanism 20 is received in housing 12 and includes an electrically powered motor for rotating the cutter elements 21. The cutter elements 21 are preferably rotating in an interleaving relationship for shredding paper sheets, fed from the tray 14, therein.

In an embodiment, the tray 14 may comprise a lid 18, which, for example, may be a pivoting lid 18 with hinges 19. The tray 14 comprises a feed bed 15 and designed to hold a plurality or stack of paper sheets 22 that are to be shredded, and thus drawn into the shredder mechanism 20. In an embodiment, feed bed 15 is a curved or sloped feed bed. Also, as shown in FIG. 6*e*, when the lid 18 is in the closed position, an opening or gap 32 may be formed between the lid and bottom of the tray 14 or feed bed. Thus, the tray 14 may also be filled by inserting paper sheets (e.g., a single sheet or a small stack) through the gap 32 and into the feed bed 15 without having to lift the lid 18.

The shredder may also comprise a switch 28 or any number of sensors as previously described. In an embodiment, a sensor is provided in tray 14 for sensing the presence of paper sheets or a stack 22. The sensor may be used to communicate with the controller that sheets are ready to be shredded or destroyed, or to communicate with the feed driver system. The presence of sheets may also start a timer for controlling at least a start time for applying a vacuum to the interior of a rotatable drum 40. The sensor may be of any type, e.g., optical, electrical, mechanical, etc. and should not be limiting. The shredder 10 may also comprise a control panel A.

The shredder 10 may have any suitable construction or configuration and the illustrated embodiment is not intended to be limiting in any way.

The rotating drum mechanism 38 comprises a rotatable drum 40, vacuum generator 46 (e.g, see FIGS. 6*a*-6*e*) and a feed driver system (not shown) designed to work in cooperation with the stack 22 in the tray 14. As shown, the rotating drum 40 is positioned above or adjacent the bed 15 of the tray 14 and along a horizontal axis. The rotating drum 40 has an exterior paper engaging surface 52 that is at least in part air permeable.

The rotating drum 40 comprises a generally round configuration. The drum 40 may be of a circular or oval shape, for example. In an embodiment, the rotation of drum mechanism 38 or drum 40 is activated when the shredder mechanism 20 is activated. In an embodiment, the rotation of drum 40 is activated when the lid 18 of tray 14 is moved to a closed position (i.e., inhibiting access to the bed 15 of the tray 14). In an embodiment, the drum 40 is rotated using a motor(s) and/or drive wheel mechanism(s). In an embodiment, the drum 40 is rotated and activated for rotation using the same motor used to drive the shredder mechanism 20. For example, the rotation of the drum 40 may be linked by belts, axles, or gears, as known in the art, to rotate upon activation of the cutter elements 21 in the shredder mechanism 20. In an embodiment, the drum 40 uses a separate motor for rotation.

The rotating drum 40 works in cooperation with the vacuum generator 46 to advance paper through the cutter elements 21 of the shredder mechanism 20. In one embodiment, the vacuum generator 46 comprises a fan mechanism and a fan exhaust or blower 48 (see, e.g., FIG. 6*a*) that are used to feed one or more top sheets from the stack 22 in the tray 14. The vacuum generator or fan 46 is used to apply a vacuum to the interior of the rotatable drum 40, to draw air through the exterior paper engaging surface 52, thereby lifting one or more sheet(s) 30 from atop the stack 22 in the tray 14.

In an embodiment, the exhaust 48 from the fan 46 is blown into the feed bed 15 to raise at least the top sheet(s) of the paper and separate at least the top sheet(s) from the stack of paper sheets 22. That is, the same fan may be used as the vacuum generator and as the blower or exhaust. In another embodiment, two separate fans or mechanisms may be used as the vacuum and blower/exhaust.

In an embodiment, the vacuum generator 46 is activated when the shredder mechanism 20 is activated. In an embodiment, the vacuum generator 46 is activated when the lid 18 of the tray 14 is moved to a closed position.

Figure 5:
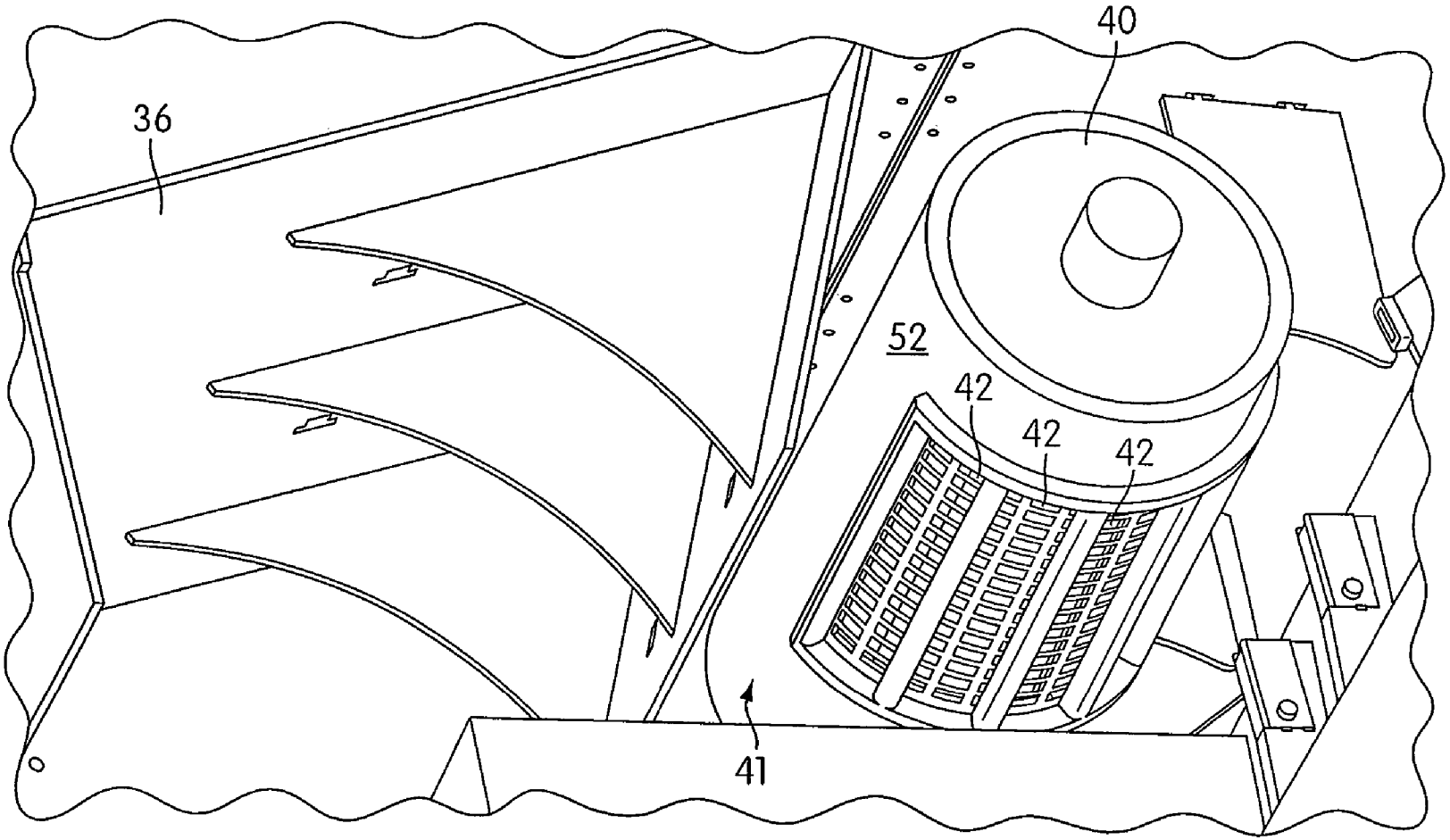
FIG. 5 is a detailed underside view of the rotatable drum of FIG. 4.

FIGS. 6*a*-6*e* show side views of the rotating drum mechanism 38 of FIGS. 4 and 5 for advancing paper in accordance with an embodiment of the present invention. As previously noted, the feed driver system of shredder 10 is constructed to rotate and move the rotating drum 40. The feed driver system is constructed to move and rotate the rotating drum 40 such that when at least a top sheet is engaged to its exterior surface 52 it feeds paper atop the stack 22 in the bed 15 of the tray 14 to the cutter elements 21 of the shredder mechanism 20.

Figure 6A:
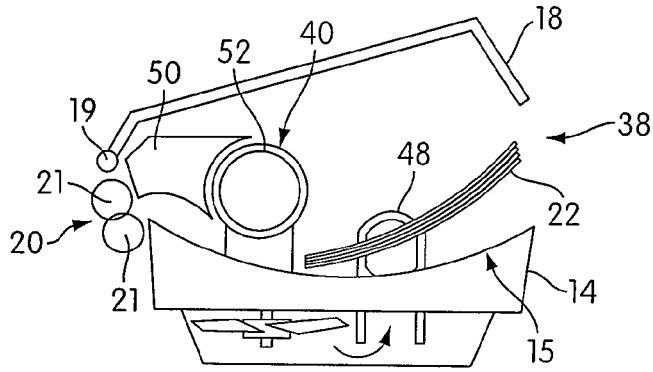
FIGS. 6*a*-6*e* show side views of the rotatable drum of FIG. 4 for advancing paper in accordance with an embodiment of the present invention.
Figure 6B:
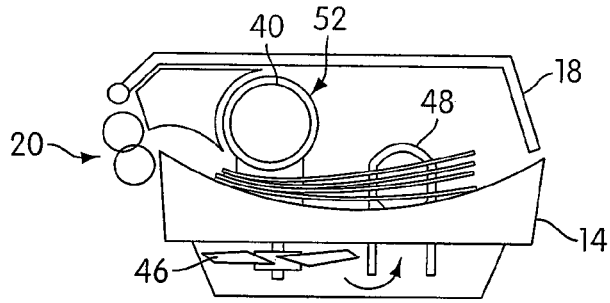
Figure 6C:
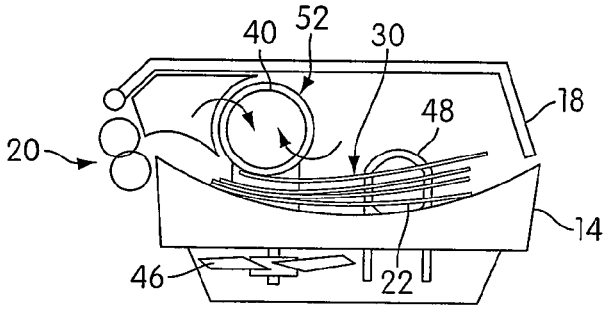
Figure 6D:
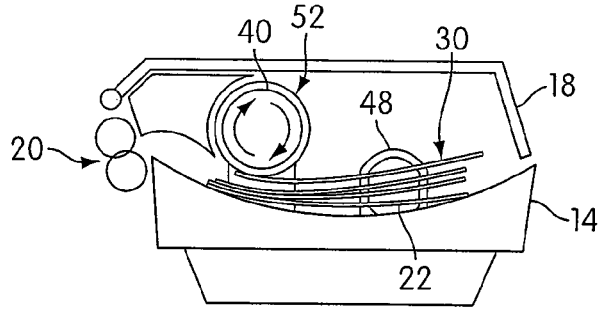
Figure 6E:
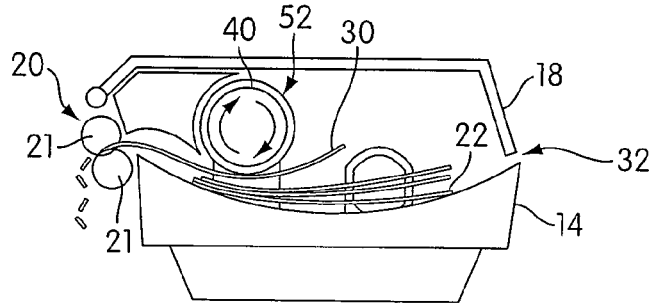

The embodiment of FIGS. 6*a*-6*e* uses a fan 46 to generate both a vacuum and exhaust 48 in the shredder 10. As shown in FIG. 6*a*, the lid 18 may be pivoted upon hinges 19 to allow access to the inside of the tray 14 or feed bed 15. In an embodiment, when the lid 18 is lifted, the rotatable drum 40 and feed driver system are deactivated such that paper may be inserted into the feed bed 15 of the tray 14. After insertion of the paper sheets or stack 22, the lid 18 is pivoted closed as seen in FIG. 6*b*, and the shredder mechanism 20, rotating drum mechanism 38, and feed driver system of the shredder 10 are activated (e.g., upon closure of the lid 18, via a sensor, or manually). As noted above, a sensor may be used to communicate and activate the feed driver system, i.e., the rotatable drum 40, using an optical sensor, electromechanical sensor, or switch, for example.

In an embodiment, the driver system comprises a timer for controlling at least the start time or activation of vacuum generator or fan mechanism 46. The vacuum or fan 46 is activated to produce a vacuum within the interior of the rotatable drum 40. The vacuum or fan 46 draws air through the exterior paper engaging surface 52. As noted above, the fan 46 is used to provide both the vacuum and blower/exhaust 48. Thus, when activated, the blower/exhaust 48 is also activated, blowing air into the tray 14 and bed 15.

As shown in FIG. 6*b*, when exhaust 48 is activated, the air causes at least the top sheet(s) 30 of paper to lift and separate from part of the other sheets of paper in the stack 22. The separation of at least the top sheet 30 of paper from atop the stack 22 allows for the vacuum applied to the center of rotating drum 40 to more easily draw the sheet of paper to the exterior paper engaging surface 52.

As shown in FIG. 6*c*, after initiation of the vacuum 46, one or more top sheets 30 of paper lifts from the stack 22 and onto the exterior paper engaging surface 52. The feed drive system is constructed to rotate the drum 40 to feed at least the top sheet 30 of the stack into the shredder mechanism 20. Specifically, as the rotatable drum 40 rotates, as shown in FIGS. 6*d* and 6*e*, the paper is advanced and fed forward into the shredder mechanism 20 and between cutter elements 21 for shredding. The sheet(s) 30 are grasped and pulled into the shredder mechanism 20 by the cutter elements 21. The exhaust 48 may continue to blow and keep at least one top sheet of paper slightly lifted and separated from the stack. The rotatable drum 40 continues to grab and advance one or more top sheets into the shredder mechanism 20 until all of the paper sheets in stack 22 have been shredded.

In one embodiment, a paper removal device 50 is provided. FIGS. 6*a*-6*e* show a positioning and use of a paper removal device 50, for example. The paper removal device 50 may be designed such that it at least partially surrounds or at least is positioned adjacent a surface of the rotating drum 40 in the shredder 10. The paper removal device 50 may be provided between the feed driver system and the shredder mechanism. The paper removal device 50 is used to ensure removal of the paper sheet(s) from the rotating drum 40, should the vacuum that is applied to the interior of the drum 40 continue hold the sheet(s) to the exterior paper engaging surface 52. That is, when paper from the stack 22 is lifted to the exterior paper engaging surface 52 via vacuum from fan 46, the paper removal device 50 may provide assistance for removing the paper sheet(s) from the surface 52 as the drum 40 rotates and feeds the paper into the cutter elements 21 of the shredder mechanism 20.

In an embodiment, a filter may be provided in rotatable drum 40 to filter particles that may be drawn in by the vacuum applied to its interior (e.g., paper pieces, dust, etc.).

Also shown in the Figures, as described with reference to FIGS. 4 and 10, is an embodiment wherein a stripping device 36 may be used for stripping paper sheet(s) from staple(s). A sloped feed bed 15 may also be provided.

Further, in an embodiment, the rotation of rotatable drum 40 may be used to advance sheet(s) only partially. Thus, sheets which are torn, folded, of different size (e.g., letter size, legal size, etc.), type (e.g., white paper, envelopes, etc.), or construction are advanced into the shredder mechanism 20.

In one embodiment, the rotating drum 40 comprises an inner cylinder (not shown) and an outer cylinder 41. For example, with reference to FIG. 5, the outer cylinder 41 of the drum 40 has a plurality of openings 42. The plurality of openings 42 form at least part of the paper engaging surface 52. In an embodiment, the outer cylinder 41 comprises openings 42 partially around its circumference. For example, the openings 42 may be provided in succession along 180 degrees of the entire 360 degree circumference of the cylinder 41 (i.e., halfway). The inner cylinder (not shown) is provided within outer cylinder. The inner cylinder comprises at least one opening (not shown) focused toward the stack 22 in the tray 14. During operation, the outer cylinder 41 rotates with respect to the inner cylinder (and stack 22). As the outer cylinder 41 rotates, the openings 42 align with the opening of the inner cylinder such that a concentrated vacuum (e.g., from fan 46 applied to the interior of inner cylinder) is applied through the openings 42 toward stack 22, so as to lift at least one sheet atop the stack 22 towards the adjacent paper engaging surface 52 of the outer cylinder 41. Thus, the top sheet(s) is lifted from the stack 22 using a maximum vacuum force along the paper engaging surface 52 of the cylinder 41. As the openings 42 of the outer cylinder 41 rotate up and away, the sheet(s) of paper may be released and pulled into the shredder mechanism 20 by the cutter elements 21 for shredding of the sheet(s).

In an embodiment, both the outer cylinder 41 and the inner cylinder rotate. Similarly, as noted above, as the openings 42 of the outer cylinder 41 rotate with respect to the inner cylinder (as the inner cylinder also rotates), and with respect to the stack 22 in tray 14 (e.g., from fan 46 applied to the interior of the drum 40). As the cylinders rotate, the openings 42 in the paper engaging surface 52 of the outer cylinder 41 align with the at least one opening (not shown) of the inner cylinder. In an embodiment, the openings of the cylinders are designed such that during rotation a concentrated vacuum is applied through openings 42 toward or adjacent the stack 22, thus providing a maximum vacuum force along the paper engaging surface 52. The top sheet(s) of paper from the stack 22 are then be lifted and rotated toward the shredder mechanism 20 as previously described. As the openings 42 of the outer cylinder 41 rotate up and away, the sheet(s) of paper may be released and pulled into the shredder mechanism 20 by the cutter elements 21 for shredding of the sheet(s).

FIGS. 7*a*-7*e* show side views of a rotatable cam feed mechanism 72 for advancing paper in a shredder 10 in accordance with an embodiment of the present invention. The shredder 10 used in FIGS. 7*a*-7*e* comprises a housing 12, tray 14, container 16, paper shredder mechanism 20, and cutter elements 21 as described in the previous Figures. The rotatable cam feed mechanism 72 is an advancement mechanism used in a similar manner as previously described with reference to FIGS. 1 and 3*a*-3*e*.

The rotatable cam feed mechanism 72 comprises a rotatable cam 74, elongated opening 76, axle 78, and a feed driver system (not shown) designed to work in cooperation with the stack 22 in the tray 14. As shown, the rotatable cam 74 is of the cam feed mechanism 72 is positioned above the bed 15 of the tray 14.

In an embodiment, the rotatable cam 74 is mounted at least on the axle 78. In an embodiment, the axle 78 is provided on a horizontal axis that is parallel to tray 14. The cam 74 is rotated on the axle 78 to engage and disengage the stack. As shown, the shape of the rotatable cam 74 is designed such that as it rotates about the axis of axle 78, the feed end 75 or feed head of the cam 74 engages and disengages with the top of the stack 22.

In an embodiment, rotatable cam 74 is provided with elongated opening 76. The elongated opening 76 is provided within the body of the cam 74 and is used to mount the cam 74 on the axle 78. Thus, when the cam 74 is rotated, the elongated opening 76 allows the cam 74 to slide from a raised position (i.e., disengaged from the stack) to a lowered position (i.e., engaged with the stack).

In an embodiment, similar to the feed mechanism 23 of FIGS. 2 and 3*a*-3*e*, the feed driver system of shredder 10 is constructed to rotate and move the rotatable cam 74 in FIGS. 7*a*-7*e*. The feed driver system is constructed to rotate the rotatable cam 74 on axle 78 to engage and feed paper atop the stack 22 in the bed 15 of the tray 14 to the cutter elements 21 of the shredder mechanism 20. In an embodiment, the feed driver system is constructed and arranged to also move the cam 74 (during rotation) such that feed end 75 moves down into engagement with the stack and out of engagement with the stack using elongated opening 76. The motors, gears, and drive mechanisms as described with reference to the rotatable feed roller and arm of FIGS. 2 and 3*a*-3*e* may similarly be used with the herein described rotatable cam.

Figure 7A:
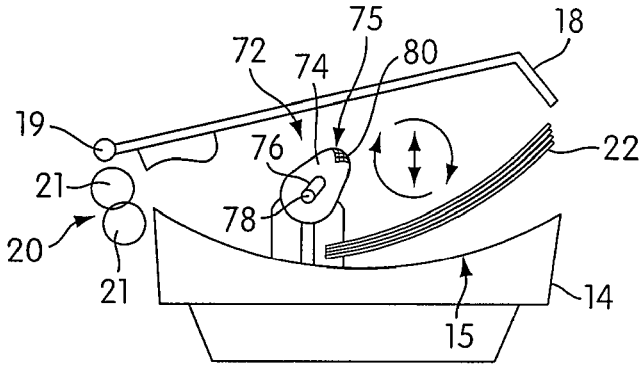
FIGS. 7*a*-7*e* show side views of a rotatable cam mechanism for advancing paper in accordance with an embodiment of the present invention.
Figure 7B:
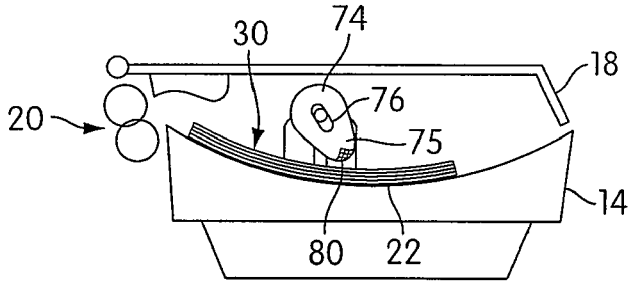
Figure 7C:
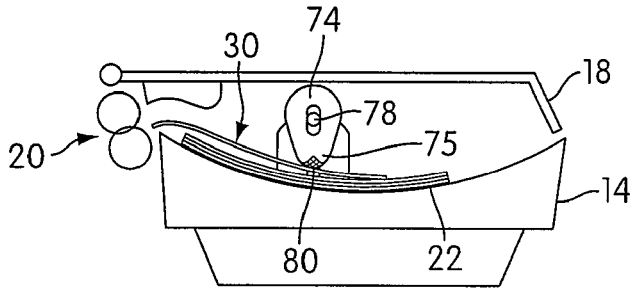
Figure 7D:
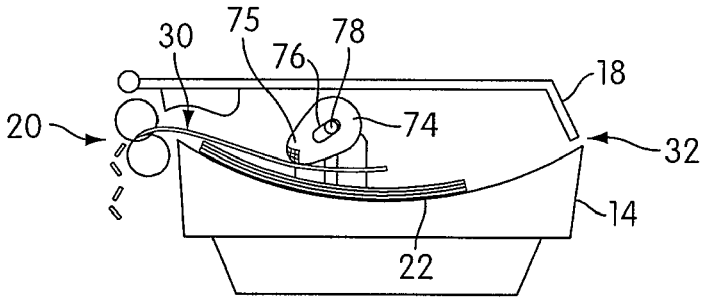
Figure 7E:
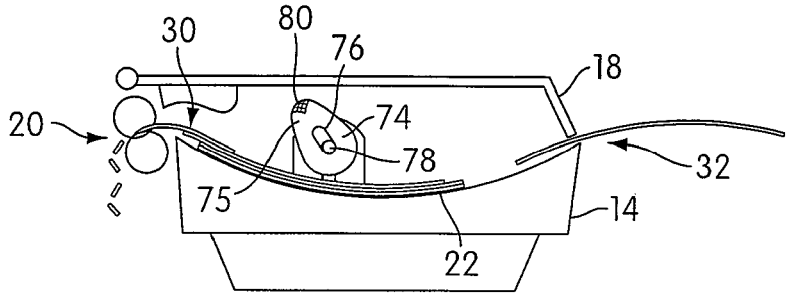

As shown in FIG. 7*a*, the lid 18 may be pivoted upon hinges 19 to allows access to the inside of the tray 14 or feed bed 15. In an embodiment, when the lid 18 is lifted, the rotatable cam 74 is actuated such that it is moved up to a raised position such that paper may be inserted into the feed bed 15 of the tray 14. For example, the cam 74 may be moved using elongated opening 76 and axle 78. After insertion of the paper sheets or stack 22, the lid is pivoted closed as seen in FIG. 7*a*, and the shredder mechanism 20 and feed driver system of the shredder are activated, either automatically (e.g., upon closure of the lid 18 or via sensors) or manually (e.g., via power switch 28). As noted above, a sensor detecting the presence of paper on the feed bed 15 may be used to communicated and activate the feed driver system, i.e., rotatable cam 74, using an optical sensor, electromechanical sensor, or switch. In an embodiment, the driver system comprises a timer for controlling at least the movement of the rotatable cam 74, i.e., activating and/or deactivating the rotation of the cam 74.

When the shredder 10 is activated, the cam 74 is rotated such that the head 75 engages the top of the stack 22, as shown in FIG. 3*c*. At least a top sheet 30 of the stack 22 is fed into the shredder mechanism 20. Specifically, the cam 74 is rotated about and along axis 78 and the sheet(s) 30 is advanced and fed forward by head 75 into the cutting elements 21 of the shredder mechanism 20. As the sheet(s) 30 is (are) fed forward, the head 75 of the rotatable cam 74 moves to a raised position, as down in FIGS. 7*d*-7*e*, such that cam 74 disengages from the stack 22. Thus, the sheet(s) 30 may be pulled into the shredder mechanism 20 by the cutter elements 21 themselves, as they grasp and destroy the paper between the cutter elements 21. The head 75 of the rotatable cam 74 then moves back to re-engage the stack 22 and advance the next or top sheet(s) into the shredder mechanism 20.

The advantage of using the rotatable cam 74 is that it reduces jamming from occurring as the feed head 75 moves in and out of contact with the paper sheets of the stack 22. Additionally, should a sloped feed bed be provided (as shown in FIGS. 7*a*-7*e*), the sloped feed bed also assists in preventing jamming.

Additionally, in an embodiment, the movement of the cam 74 may be used to advance sheet(s) only partially, as described above with reference to the feed roller of FIGS. 2 and 3*a*-3*e*.

In an embodiment, rotatable cam 74 comprises at least one opening that is at least in part air permeable. In an embodiment, the opening comprises a vacuum port 80. As shown in FIGS. 7*a*-7*e*, vacuum port 80 may be provided near or on the end of feed end 75. The vacuum port 80 provides a concentrated vacuum for drawing air into the rotatable cam 74. Thus, the vacuum port 80 assists in lifting at least a top sheet(s) 30 from the stack 22. As the cam 74 is rotated on the axis, the end 75 moves into engagement with the stack 22, and the concentrated vacuum lifts at least the top sheet(s) 30 from the stack 80 and into contact with the vacuum port 80 of the cam 74. As the sheet(s) 30 are rotated toward shredder mechanism 20, the end 75 of cam 74 is rotated up and away such that the end(s) of the sheet(s) are pulled into the cutter elements 21 for shredding. Thus, the vacuum port 80 is rotated out of contact with the sheet(s) 30 as the end 75 of the cam 74 is rotated away from the stack 22.

An exhaust port (not shown) may also be provided on the outside of the shredder or within the tray 14 so as to lift one or more sheets from the top of the stack 22 as described with respect to FIGS. 6*a*-6*e*.

FIGS. 8*a*-8*f* show side views and a top view of a rotating feed belt mechanism 82 for shredder 10 for advancing paper in accordance with an embodiment of the present invention. The shredder 10 used in FIGS. 8*a*-8*f* comprises a housing 12, tray 14, container 16, paper shredder mechanism 20, and cutter elements 21 as described in the previous Figures. The rotating feed belt mechanism 82 may be used as an advancement mechanism in a similar manner as previously described with reference to FIGS. 1, 4, and 6*a*-6*e*.

Figure 8A:
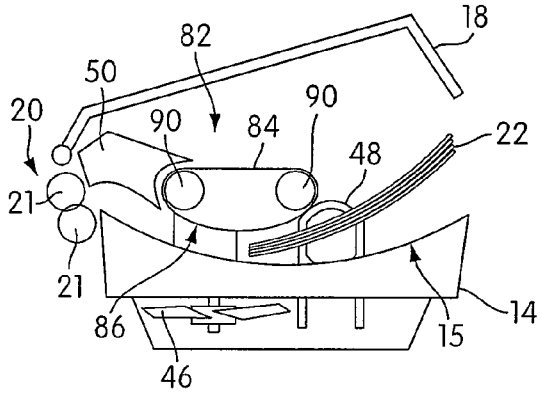
FIGS. 8*a*-8*f* show side views and a top view of a feed belt mechanism for advancing paper in accordance with an embodiment of the present invention.

The rotating feed belt mechanism 82 comprises an "endless" feed belt 84. The rotating feed belt mechanism 82 also comprises a fan or vacuum generator 46, exhaust or blower 48, tube stripper 50, and feed driver system (not shown), as previously described with reference to FIGS. 4-6*e*, designed to work in cooperation with the stack 22 in the tray 14. As shown in FIG. 8*a*, the belt 84 is positioned above the bed 15 of the tray 14. The belt 84 rotates about two tubes 90, for example. In an embodiment, the belt 84 has an exterior paper engaging surface 86 that is at least in part air permeable. In an embodiment, the paper engaging surface 86 comprises a plurality of elongated openings 88 that extend through the belt 84.

Figure 8B:
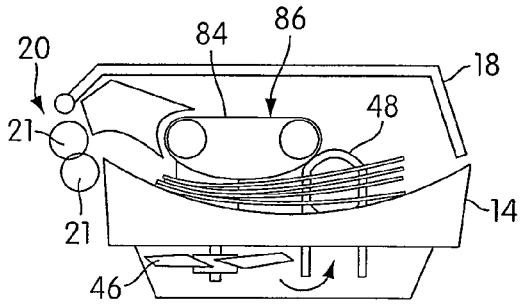

The paper engaging surface 86 of the belt 84 is constructed and arranged to advance paper through the shredder mechanism 20. As shown in FIG. 8*f*, the belt 84 rotates about two tubes 90 to provide an elongate surface 86 to engage and advance paper. The elongated openings 88 are shown in a spaced apart relation, and are designed to provide a concentration of air when used with vacuum generator 46. Although the openings 88 are shown spanning the width of the belt 84, the openings may be any shape or size. For example, the belt 84 may have small holes that are at least in part air permeable. The size and shape of the openings of rotatable belt 84 should not be limiting.

In an embodiment, the rotation of rotating feed belt mechanism 82 or belt 84 is activated when the shredder mechanism 20 is activated. In an embodiment, the advancement of belt 84 is activated when the lid 18 of tray 14 is moved to a closed position (i.e., inhibiting access to the bed 5 of the tray 14). In an embodiment, belt 84 is moved using motor(s) and/or drive wheel mechanism(s). In an embodiment, the belt 84 is driven using the same motor used to drive the shredder mechanism 20. For example, the movement of the belt 84 may be linked by belts, axles, or gears, as known in the art, to rotation upon activation of the cutter elements 21 in the shredder mechanism 20. In an embodiment, the belt 84 used a separate motor.

The belt 84 works in cooperation with the vacuum generator 46 to advance paper through the cutter elements 21 of the shredder mechanism 20, as shown in FIGS. 8*b*-8*e*. In an embodiment, the vacuum generator 46 comprises a fan mechanism, and, as previously noted, a fan exhaust or blower 48, that are used to feed one or more top sheets from the stack 22 in the tray 14. The vacuum generator or fan 46 is used to apply a vacuum to the interior of the belt 84 to draw air through the exterior paper engaging surface 86 (i.e., using elongated openings 88), thereby lifting one or more top sheets 30 from the stack 22 in the tray 14.

In an embodiment, the fan exhaust 48 is blown into the feed bed 15 to raise at least the top sheet(s) 30 of the paper and separate at least the top sheet(s) 30 from the stack of paper sheets 22. In an embodiment, the same fan may be used as the vacuum generator and as the blower. In another embodiment, two separate fans or mechanisms may be used for the vacuum and the blower.

In an embodiment, the vacuum generator 46 is activated when the shredder mechanism 20 is activated. In an embodiment, the vacuum generator 46 is activated when the lid 18 of the tray 14 is moved to a closed position.

As previously noted, the feed driver system (not shown) of shredder 10 is constructed to rotate and move the belt 84. The embodiment described in FIGS. 8*a*-8*e* uses the fan 46 to generate both a vacuum and exhaust 48 in the shredder 10. This example is for explanatory purposes only and should not be limiting.

Similarly to the previously described embodiments, lid 18 may be pivoted upon hinges 19 to allow access to the inside of the tray 14 of feed bed 15. In an embodiment, when the lid 18 is lifted, the belt 84 and feed driver system are deactivated such that paper may be inserted into the feed bed 15 of the tray 14. After the lid 18 is pivoted closed as shown in FIG. 8*b*, the shredder mechanism 20, rotating feed belt mechanism 82, and feed driver system are activated. As noted above, a sensor may be used to communicate and activate the feed driver system, i.e., the belt mechanism 82, using an optical sensor, electromechanical sensor, or switch, for example.

In an embodiment, the driver comprises a timer for controlling at least the activation of vacuum generator or fan mechanism 46. The vacuum or fan 46 is activated to produce a vacuum within the interior of the belt 84. The vacuum or fan 46 draws air through the exterior paper engaging surface 86 and/or elongated openings 88.

As noted above, fan 46 may be used to provide both the vacuum and blower exhaust 48. Thus, when the shredder 10 is activated, the blower or exhaust 48 is also activated, blowing air into the tray 14 and bed 15. As shown in FIG. 8*b*, when exhaust 48 is activated, at least the top sheet(s) 30 of paper are lifted and separated from the other sheets of paper in the stack 22. The separation of at least the top sheet 30 of paper from the stack 2 allows from the vacuum applied to the center of the belt 84 to more easily draw the sheet of paper to the exterior paper engaging surface 86.

Figure 8C:
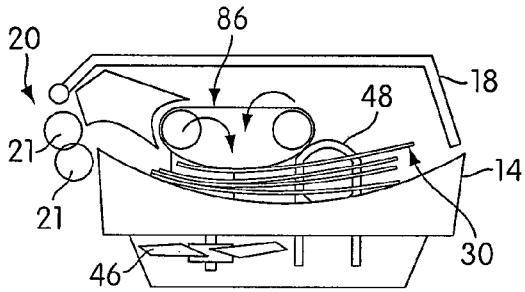
Figure 8D:
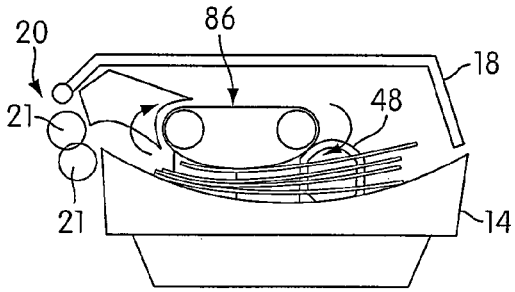
Figure 8E:
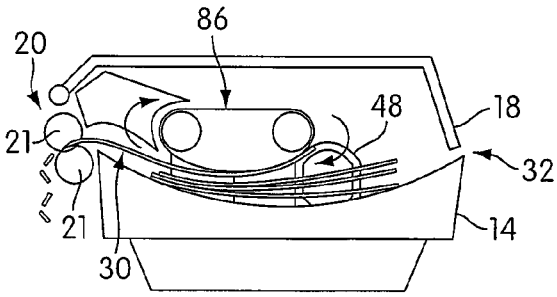
Figure 8F:
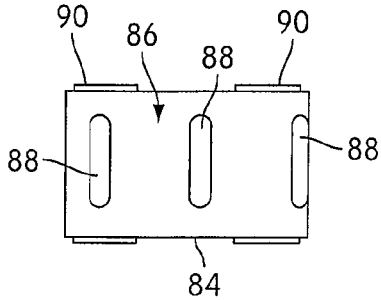

As shown in FIG. 8*c*, the initiation of the vacuum 46 lifts the paper 30 from the tack 22 and onto the engaging surface 86. The feed drive system is constructed to drive the belt 84 about tubes 90 to feed at least the top sheet 40 of the stack in to the shredder mechanism 20. Specifically, as the belt 84 is driven, as shown in FIGS. 8*d* and 8*e*, the paper is advanced and fed forward into the shredder mechanism 20 and between cutter elements 21 for shredding. The sheet(s) are grasped and pulled into the shredder mechanism 20 by the cutter elements 21. The exhaust 48 may continue to blow to keep at least one top sheet 30 of paper slightly lifted and separated from the stack 22. The belt 84 continues to advance one or more top sheets into the shredder mechanism 20 until all of the paper sheets 22 in the stack 22 have been shred.

As noted with respect to FIGS. 6*a*-6*e*, in one embodiment, the paper removal device 50 may be provided. The paper removal device 50 is designed to work as described with reference to FIGS. 6*a*-6*e*, wherein the device 50 may at least partially surround or at least be positioned adjacent a surface of the belt 84 in the shredder 10 and assist in the removal of paper sheets from the exterior surface 86 of the belt 84 as it rotates to feed paper into the cutter elements 21 of the shredder mechanism 20. A stripping device 36, as described above with reference to FIGS. 4 and 10, may also be provided to work with the rotating belt mechanism 82.

The advancement mechanisms for "automatically" feeding one or more sheets as described in FIGS. 3*a*-3*e*, 6*a*-6*e*, 7*a*-7*e*, and 8*a*-8*f* of shredder 10 ideally allow a user to drop off a stack of paper sheets or documents without having the need to manually feed individual or a present quantity of sheets into the shredder 10. For example, a user would add a stack of documents to the tray 14 and be able to walk away. The shredder 10 may then either automatically engage in shredding the documents in the tray 14 (e.g., upon closure of the lid 18 or via sensor), or set a preset timer so as to delay the time the shredder 10 is activated for the shredding process to begin. A user may also activate the shredding process by pushing a button on the control panel A (e.g., button 56).

One major advantage of the described advancement mechanisms in shredder 10 is the decreased amount of time a user must spend shredding documents. For example, the productivity of a user would be improved since the user is able to perform other tasks while the shredder 10 is activated. Another advantage is that the shredder 10 is designed to handle paper or documents of different sizes, textures, shapes, and thicknesses, including letter, legal, and A4 size paper, as well as envelopes and stapled sheets, for example. The documents may also be in any order.

Optionally, the shredder 10 may be utilized in a system having a centrally located shredder unit for a multitude of users. For example, the shredder 10 allows for each individual to save what they need to shred at a later time in their own individual tray. An individual can fill his or her own tray until shredding is needed. Each individual may then insert the tray into the shredder 10. In an embodiment, each individual tray may comprise a locking mechanism, such that documents may be secured within the tray, as well as to the work area of the individual, for additional security of the documents to be shredded.

The shredder 10 may also be utilized in a system wherein users use a mobile cart device to pick up items to be shred, for example. The cart device may be used to pick up individual trays or allow users to securely add documents that need to be shredded to a locked tray. Thus, other users or services may be used to shred documents without having access to such documents.

Figure 9A:
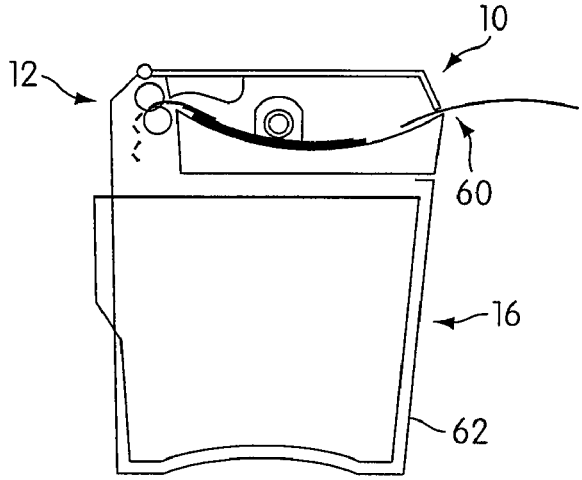
FIG. 9*a* shows a side view of a shredder of alternate configuration comprising a detachable paper shredder mechanism in accordance with an embodiment.
Figure 9B:
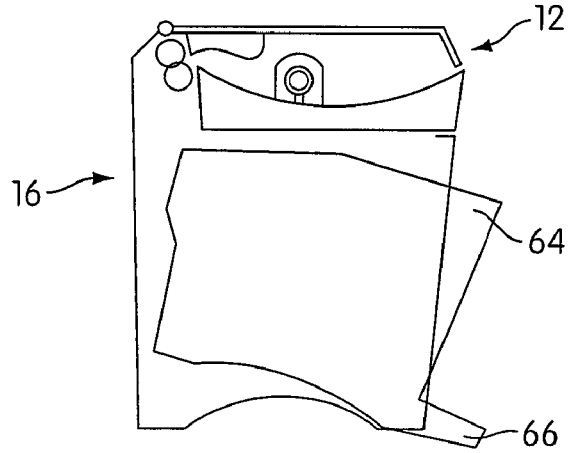
FIG. 9*b* shows a side view of a shredder of alternate configuration comprising a removable waste bin in accordance with an embodiment.
Figure 9C:
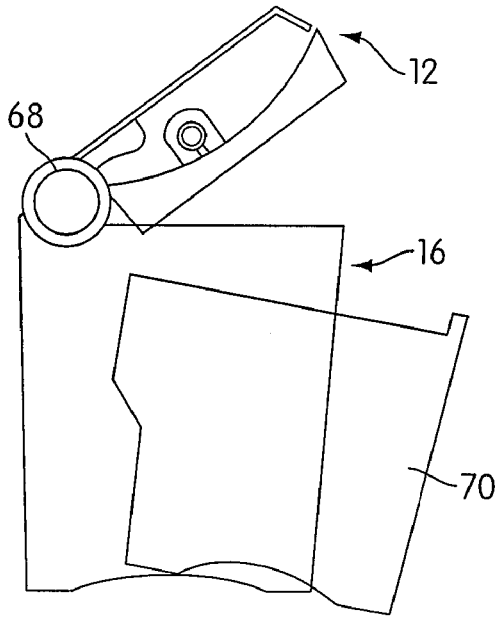
FIG. 9*c* shows a side view of a shredder of alternate configuration comprising a hinged shredder mechanism and a removable waste bin in accordance with an embodiment.

As noted above with respect to FIG. 1, the shredder 10 comprises a housing 12 that sits on top of a container 16. FIGS. 9*a*-9*c* illustrate shredder devices of alternate configuration in accordance with embodiments of the present invention. As previously noted, the container 16 may be a waste bin, or may also be used to house a separate and removable waste bin, for example. FIG. 9*a* shows a side view of a shredder device of alternate configuration comprising a detachable paper shredder mechanism 60. The housing 12 may be a detachable shredder mechanism 60 that may be removed from the container 16, for example, for emptying the container 16 (or a waste bin 62) of shredded paper chips or strips, for example.

FIG. 9*b* shows a side view of a shredder device of alternate configuration comprising a removable waste bin 64. The waste bin 64 may comprise a step or pedal device 66 that allows a user to access the bin and discard waste into the bin 64 without being passed through the shredder mechanism 20. The step or pedal device 66 may also be provided to allow a user to easily access the bin 64 for emptying shredded paper, for example.

FIG. 9*c* shows a side view of a shredder device of alternate configuration comprising a housing 12 with a hinge 68 and a removable waste bin 70. The shredder device may comprise the ability for a user to access the container 16 or waste bin 70 by pivoting and lifting the housing 12 on hinge 68. The waste bin 70 may also be removed by a user when shredded paper needs to be removed, for example.

Although a waste bin is described as being provided in the container 16 in the above embodiments, it is optional and may omitted entirely. Generally, container 16 may have any suitable construction or configuration.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A shredder comprising:

a housing;

a paper shredder mechanism received in the housing and including a motor and cutter elements, the motor rotating the cutter elements in an interleaving relationship for shredding paper sheets fed therein;

a tray for holding a stack of paper sheets to be fed into the cutter elements;

a moveable paper feed mechanism positioned above the tray, the moveable paper feed mechanism having an exterior paper engaging surface that is at least in part air permeable and rotatable;

a vacuum generator for applying a vacuum to an interior of the moveable paper feed mechanism to draw air through the exterior paper engaging surface, thereby lifting at least a top sheet from atop the stack, and a feed driver system constructed to drive the feed mechanism by rotating the exterior paper engaging surface to feed the at least lifted top sheet to the cutter elements.

2. A shredder according to claim 1, wherein the moveable paper feed mechanism comprises a rotatable drum.

3. A shredder according to claim 2, wherein the rotatable drum is mounted on an axle, and the feed driver system comprises a rotary driver for rotating the axle so that the rotation of the drum feeds the paper atop the stack to the cutter elements.

4. A shredder according to claim 2, wherein the rotatable drum further comprises an inner cylinder for applying the vacuum and an outer cylinder having the exterior paper engaging surface, the outer cylinder comprising at least one opening for applying the vacuum, wherein, during rotation, the opening of the outer cylinder provides a concentrated vacuum toward the sheets of the stack.

5. A shredder according to claim 1, further comprising a fan mechanism constructed and arranged to provide air toward the tray to lift at least an edge of at least the lifted top sheet of the stack and thereby separate the at least lifted top sheet from the stack and into contact with the exterior paper engaging surface.

6. A shredder according to claim 5, wherein the fan mechanism utilizes the exhaust from the vacuum generator.

7. A shredder according to claim 1, wherein the moveable feed mechanism comprises a belt.

8. A shredder according to claim 7, wherein the belt is mounted on two parallel axles, and the feed driver system comprises a rotary driver for rotating the axles so that the rotation of the belt feeds the at least lifted top sheet from atop the stack to the cutter elements.

9. A shredder according to claim 1, wherein the tray includes a curved feed bed curved upwardly and forwardly towards the shredder mechanism to assist in feeding one or more sheets in a forward and upward direction into the shredder mechanism.

10. A shredder according to claim 1, wherein the rotation of the feed mechanism is activated using a device selected from the group consisting of an optical sensor, electromechanical sensor, and switch.

11. A shredder according to claim 1, wherein the driver system comprises a timer for controlling at least a time to start operation of the feed driver system and the vacuum generator.

12. A shredder according to claim 1, further comprising a pivotable lid for covering the tray.

13. A shredder according to claim 12, further comprising a safety switch for detecting if the lid is pivoted to an open position, the safety switch being coupled to the shredder mechanism and constructed and arranged to prevent operation of the cutter elements when the lid is in the open position.

14. A shredder according to claim 1, further comprising a lid for covering the tray, the lid comprising an opening for allowing insertion of paper sheets into the tray.

15. A shredder according to claim 1, wherein the shredder further comprises a device for stripping paper sheets that are stapled together in the stack as at least the top sheet of the paper sheets are fed to the cutter elements.

16. A shredder according to claim 1, wherein the shredder further comprises a waste bin for receiving paper shreds from the cutter elements.

17. A shredder according to claim 1, further comprising a paper removal device between the feed driver system and the shredder mechanism to assist in a removal of the at least lifted top sheet from the exterior paper engaging surface of the feed mechanism.

18. A shredder according to claim 17, wherein the paper removal device is positioned adjacent to the exterior paper engaging surface.

19. A shredder according to claim 1, wherein the moveable paper feed mechanism is further positioned adjacent the shredder mechanism.

20. A method for advancing paper sheets into cutter elements for shredding comprising:

providing a tray for holding a stack of paper sheets;

providing a moveable paper feed mechanism positioned above the tray, the moveable paper feed mechanism having an exterior paper engaging surface that is at least in part air permeable and rotatable;

applying a vacuum to an interior of the moveable paper feed mechanism to draw air through the exterior paper engaging surface, thereby lifting at least a top sheet from atop the stack to the exterior paper engaging surface of the drum;

rotating cutter elements in an interleaving relationship for shredding paper sheets fed therein; and driving the feed mechanism by rotating the exterior paper engaging surface to feed the at least lifted top sheet to the cutter elements.

21. A method according to claim 20, wherein the moveable paper feed mechanism comprises a rotatable drum.

22. A method according to claim 21, further comprising mounting the rotatable drum on an axle and rotating the axle so that the rotation of the drum assists in feeding the at least lifted top sheet from atop the stack to the cutter elements.

23. A method according to claim 20, wherein the moveable paper feed mechanism comprises a rotatable belt.

24. A method according to claim 23, further comprising mounting the rotatable belt on two parallel axles and rotating the axles so that the rotation of the belt assists in feeding the at least lifted top sheet from atop the stack to the cutter elements.

25. A method according to claim 20, further comprising further comprising rotating a fan mechanism to supply air to lift at least an edge of the at least lifted top sheet from atop the stack and thereby separate the at least lifted top sheet from the stack and into contact with the exterior paper engaging surface.

26. A method according to claim 20, further comprising activating the rotation of the moveable paper feed mechanism using a device selected from the group consisting of an optical sensor, electromechanical sensor, and switch.

27. A method according to claim 20, further comprising controlling at least a start time for operating the vacuum generator and driving the feed mechanism using a timer.

28. A method according to claim 20, further comprising detecting if a lid of the tray is pivoted to an open position, and preventing operation of the cutter elements if the lid is in the open position.

29. A method according to claim 20, further comprising removing the at least lifted top sheet from the exterior paper engaging surface of the feed mechanism using a paper removal device positioned between the feed driver system and the shredder mechanism.

30. A method according to claim 29, wherein the paper removal device is positioned adjacent to the exterior paper engaging surface.

31. A method according to claim 20, wherein the moveable paper feed mechanism is further positioned adjacent the shredder mechanism.

* * * * *